US007926903B2

(12) United States Patent
Yokoyama et al.

(10) Patent No.: US 7,926,903 B2
(45) Date of Patent: Apr. 19, 2011

(54) INK-JET RECORDING APPARATUS

(75) Inventors: Noriko Yokoyama, Hachioji (JP); Tomoshi Takamura, Fuchu (JP)

(73) Assignee: Olympus Corporation, Tokyo (JP)

( * ) Notice: Subject to any disclaimer, the term of this patent is extended or adjusted under 35 U.S.C. 154(b) by 415 days.

(21) Appl. No.: 12/152,211

(22) Filed: May 13, 2008

(65) Prior Publication Data

US 2008/0284816 A1 Nov. 20, 2008

(30) Foreign Application Priority Data

May 15, 2007 (JP) ..... 2007-129680

(51) Int. Cl.
*B41J 2/165* (2006.01)

(52) U.S. Cl. ..... 347/33

(58) Field of Classification Search ..... 347/33
See application file for complete search history.

(56) References Cited

U.S. PATENT DOCUMENTS

2006/0170727 A1* 8/2006 Imazeki et al. ..... 347/33

FOREIGN PATENT DOCUMENTS

JP 7-323556 A 12/1995
JP 2006-96017 A 4/2006

* cited by examiner

*Primary Examiner* — Jerry T Rahll
(74) *Attorney, Agent, or Firm* — Holtz, Holtz, Goodman & Chick, PC

(57) ABSTRACT

An ink-jet recording apparatus according to this invention has an ink-head unit, a head holder, and a wiper unit. The ink-head unit extends in a direction that intersects at right angles to the direction a recording medium is transported, for a distance equal to or longer than the width of the recording medium. The head holder holds the ink-head unit. The ink-head unit has a nozzle surface having nozzles for ejecting ink. The wiper unit has a wiper blade, which wipes the nozzle surface.

5 Claims, 16 Drawing Sheets

INK-JET RECORDING APPARATUS

CROSS-REFERENCE TO RELATED APPLICATIONS

This application is based upon and claims the benefit of priority from prior Japanese Patent Application No. 2007-129680, filed May 15, 2007, the entire contents of which are incorporated herein by reference.

BACKGROUND OF THE INVENTION

1. Field of the Invention

The present invention relates to an ink-jet recording apparatus. More particularly, the invention relates to an ink-jet recording apparatus that is improved in that the nozzle surfaces can be reliably cleaned.

2. Description of the Related Art

Ink-jet recoding apparatuses comprise an ink head that ejects ink to a recording medium. The ink head has a nozzle plate that has a plurality of nozzles which are arranged in a line and through which ink may be ejected. That surface of the nozzle plate, in which the nozzles are made, is called nozzle surface. The nozzles have a very small diameter. Therefore, the nozzles may be clogged as viscosity of the ink is increased or as foreign matter enters them. If the nozzles are so clogged, the ink will not be ejected in a desirable manner, disabling the ink-jet recording apparatus from recording high-quality images.

In order to solve this problem, most ink-jet recording apparatuses have a cleaning mechanism for cleaning the nozzles of the ink head. Two types of cleaning mechanisms are known. The cleaning mechanism of the first type applies pressure in the ink head, from inside the head. The ink is thereby forced out through the nozzles, and the foreign matter is thereby forced out from the nozzles. The cleaning mechanism of the second type caps the nozzles of the ink head. Then, the cleaning mechanism applies a suction force from outside the caps, thereby removing the foreign matter from the nozzles. Thereafter, wiper blades are set into contact with the nozzle surfaces of the nozzle plate, and the wiper blades are moved relative to the nozzle plates. The ink bonded to the nozzle plate is removed. Wiper blades for this use are disclosed in, for example, Jpn. Pat. Appln. KOKAI Publication No. 2006-96017 and Jpn. Pat. Appln. KOKAI Publication No. 7-323556. Jpn. Pat. Appln. KOKAI Publication No. 2006-96017 discloses wiper blades that are provided on a capping member.

As for the wipe blade and the capping member, a position to the nozzle surface is positioned by a cam.

Once the ink head and the wiper blades have been set at prescribed positions, the ink head or the wiping plate is moved relative to the nozzle surface, while held resiliently in contact with the nozzle surface. The residual ink is thereby removed from the nozzle surface.

Jpn. Pat. Appln. KOKAI Publication No. 7-323556 discloses wiper blades provided on a carriage that moves at right angles to the direction in which a recording medium is fed. These wiper blades are mounted on the carriage. The wiper blades are configured to move parallel to the scanning direction of the carriage.

BRIEF SUMMARY OF THE INVENTION

An ink-jet recording comprising: a transporting mechanism which transports a recording medium; an ink-head unit that has at least one ink head extending in a direction at right angles with a direction in which the recording medium is fed, the ink head having a nozzle surface in which a plurality of nozzles are arranged, through which to eject ink to record an image, the ink head being as wide as or wider than the recording medium; a head-holding unit which holds the ink-head unit to be opposed to the transporting mechanism; and a blade unit which has a wiper blade for wiping the nozzle surface, the blade unit being held by the head-holding unit.

Advantages of the invention will be set forth in the description which follows, and in part will be obvious from the description, or may be learned by practice of the invention. Advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Embodiments of the present invention will be described, with reference to the accompanying drawings.

First Embodiment

Figure 1A:
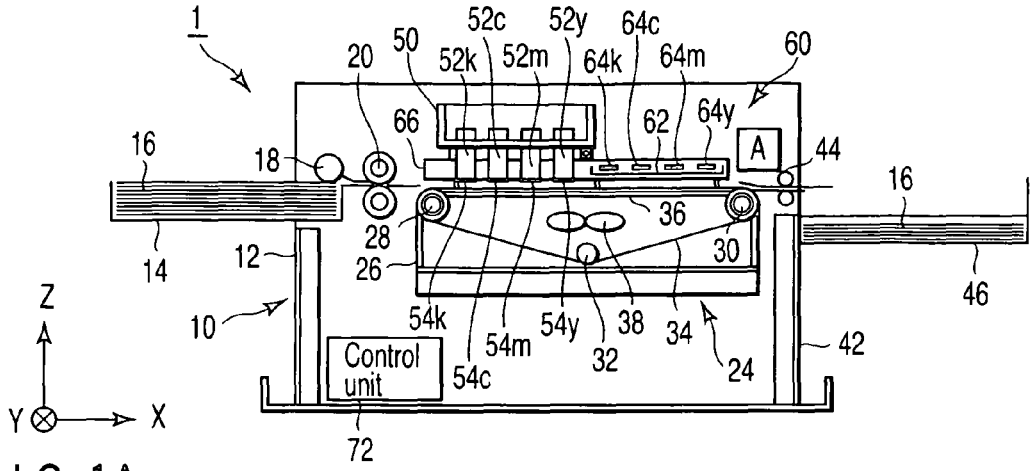
FIGS. 1A to 1C are diagrams showing the overall configuration of an ink-jet recording apparatus according to a first embodiment of this invention, FIG. 1A depicting the cap unit held at the wait position, FIG. 1B depicting the cap unit held at the ink-drawing position, and FIG. 1C depicting the wiper unit held at the ink removal position.
Figure 1B:
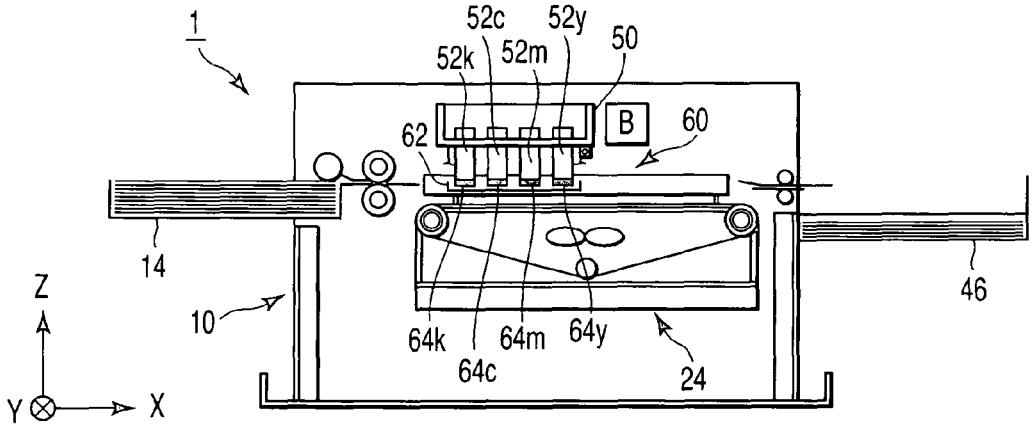
Figure 1C:
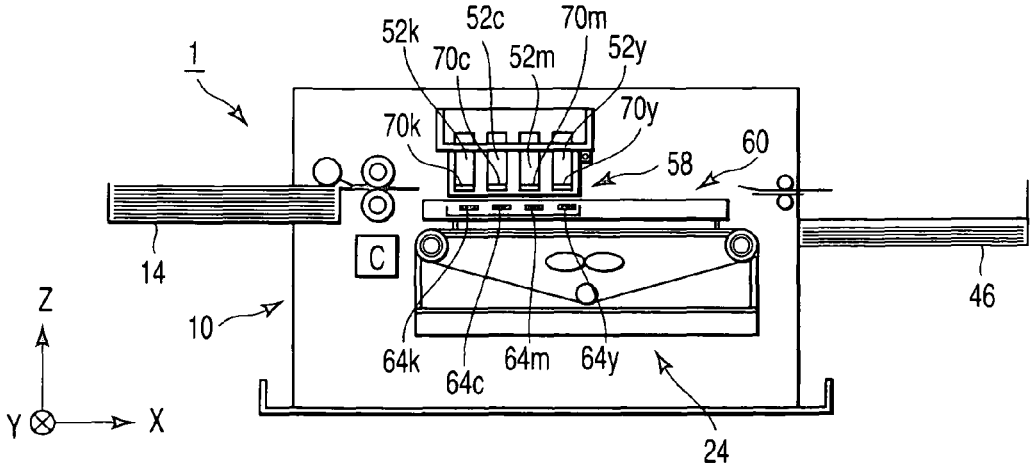

FIGS. 1A to 1C show the overall configuration of an ink-jet recording apparatus according to a first embodiment of this invention. More precisely, FIG. 1A depicts a cap unit held at the wait position during the process of recording an image. FIG. 1B depicts the cap unit held at the ink-drawing position. FIG. 1C depicts a wiper unit held at the ink removal position.

As shown in FIGS. 1A to 1C, the ink-jet recording apparatus 1 has a housing 10. On one side 12 of the housing 10, a sheet-feeding tray 14 is provided. The sheet-feeding tray 14 holds a stack of recording medium 16. In the housing 10, a pickup roller 18 is provided at the sheet-feeding edge of the sheet-feeding tray 14. The pickup roller 18 picks up recording medium 16, one by one, from the sheet-feeding tray 14 and feeds the recording medium 16, one by one, into the housing 10. In the housing 10, each recording medium 16 is transported along a transport path. At the entrance to the transport path, a pair of registration rollers 20 is provided. The registration rollers 20 convey the recording medium 16 feeding from the sheet-feeding tray 14, to a belt unit 24 as a transporting mechanism at a predetermined speed.

The belt unit 24 attracts and holds the recording medium 16 and then transports at the predetermined speed in the direction of arrow X. The belt unit 24 comprises a platen frame 26, platen rollers 28, 30 and 32, a platen 36, a suction fan 38, belt 34. The platen frame 26 supports the platen rollers 28, 30 and 32. The belt 34 is wrapped around the platen rollers 28, 30 and 32. The belt 34 is an endless belt and has many holes. Below the belt 34 and between the platen rollers 28 and 30, the platen 36 and the suction fan 38 are provided. The platen 36 has many holes.

When driven, the suction fan 38 draws air through the many holes made in the platen 36 and then through the many holes made in the belt 34. While recording medium 16 is adsorbed on the belt 34 by this, is transported to the illustration arrow X-direction at the predetermined transportation speed by each platen roller 28, 30, 32.

Note that the belt unit 24 can be moved up and down, in the direction of arrow Z, by means of a lift mechanism (not shown).

A pair of sheet ejection roller 44 is provided at the other side 42 of the housing 10. The sheet ejection roller 44 ejects the recording medium 16 out of the housing 10, the medium 16 having been transported from the belt unit 24.

A sheet ejection tray 46 is secured to the other side 42 of the housing 10. The sheet ejection tray 46 holds recording medium 16 ejected from the housing 10 by the sheet ejection roller 44.

Above the belt unit 24, a head holder 50 as a head-holding unit is arranged. The head holder 50 holds ink-head units 52*k*, 52*c*, 52*m* and 52*y*. The head holder 50 and the ink-head units 52*k*, 52*c*, 52*m* and 52*y* constitute a recording unit. Note that the number of ink-head units is not limited to this.

Figure 2:
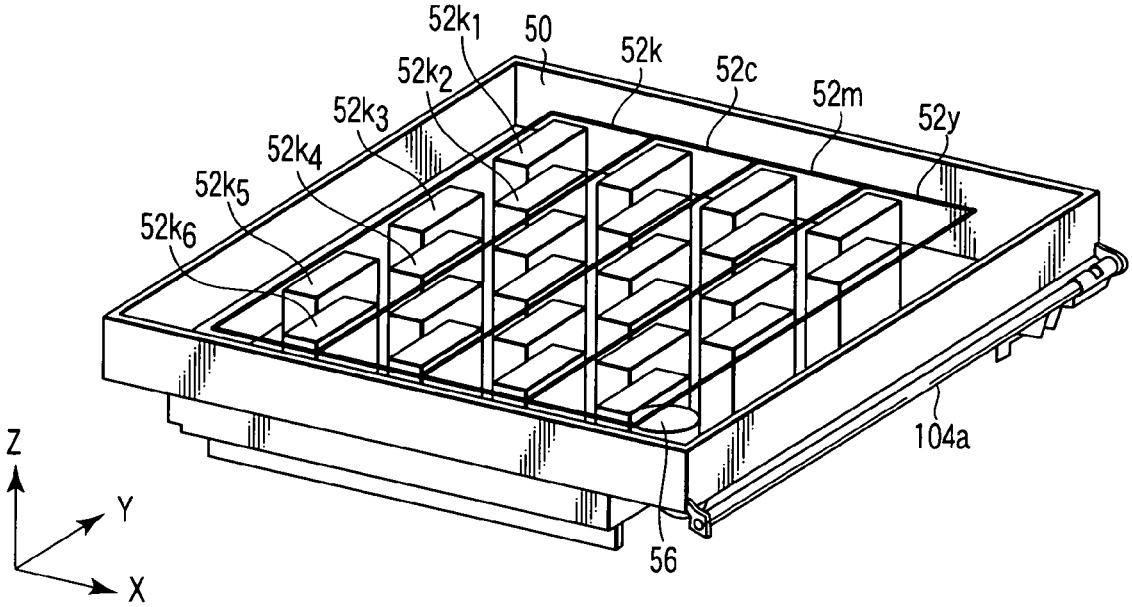
FIG. 2 is a diagram illustrating the arrangement of ink-head units used in the first embodiment.

The ink-head unit 52*k* ejects ink of color K. The ink-head unit 52*c* ejects ink of color C. The ink-head unit 52*m* ejects ink of color M. The ink-head unit 52*y* ejects ink of color Y. FIG. 2 shows the configurations of the ink-head units 52*k*, 52*m*, 52*c* and 52*y*. In the ink-head unit 52*k*, for example, six ink heads $\mathbf{52}k_1$ to $\mathbf{52}k_6$ are which are arranged in two columns, forming one ink head unit for one color. The other ink-head unit 52*c*, 52*m* and 52*y* are configured in the same way as the ink-head unit 52*k*.

The ink-head units 52*k*, 52*c*, 52*m* and 52*y* are located above the belt unit 24 and opposed to the belt 34 of the belt unit 24. The ink-head units 52*k*, 52*c*, 52*m* and 52*y* are fixed to the head holder 50 from upstream to downstream in the direction (direction of arrow X) of transporting the recording medium 16 at predetermined intervals. The ink heads of the ink-head units 52*k*, 52*c*, 52*m* and 52*y* have nozzle surfaces 54*k*, 54*c*, 54*m* and 54*y*, respectively. The nozzle surfaces 54*k*, 54*c*, 54*m* and 54*y* have a plurality of nozzles (nozzle column) each, which are arranged in one line that extends in the lengthwise direction of the ink head.

The ink-head units 52*k*, 52*c*, 52*m* and 52*y* are positioned such that the nozzle columns provided in the nozzle surfaces 54*k*, 54*c*, 54*m* and 54*y*, respectively, extend in the direction of arrow Y that intersects at right angles with the direction of arrow X, in which the recording medium 16 is transported. The ink-head units 52*k*, 52*c*, 52*m* and 52*y* are as long as or longer than the width of the recording medium 16. As shown in FIG. 2, a wiping motor 56 is fixed at that edge of the head holder 50, which is located downstream in the direction of transporting the recording medium 16. The wiping motor 56 can move a wiper unit 58 in the Y-axis direction that is secured to the head holder 50 with a guide shaft and a guide plate as will be described later in detail.

As FIGS. 1A to 1C show, a cap unit 60 is provided in the housing 10 of the ink-jet recording apparatus 1. The cap unit 60 is designed to draw ink from the nozzles made in the nozzle surfaces 54*k*, 54*c*, 54*m* and 54*y* of the ink heads of the ink-head units 52*k*, 52*c*, 52*m* and 52*y*. The cap unit 60 has an ink pan 62 and suction-cap units 64*k*, 64*c*, 64*m* and 64*y*. The suction-cap units 64*k*, 64*c*, 64*m* and 64*y* are provided in the ink pan 62, for the ink-head units 52*k*, 52*c*, 52*m* and 52*y*, respectively, as is shown in FIGS. 1A to 1C.

Figure 3:
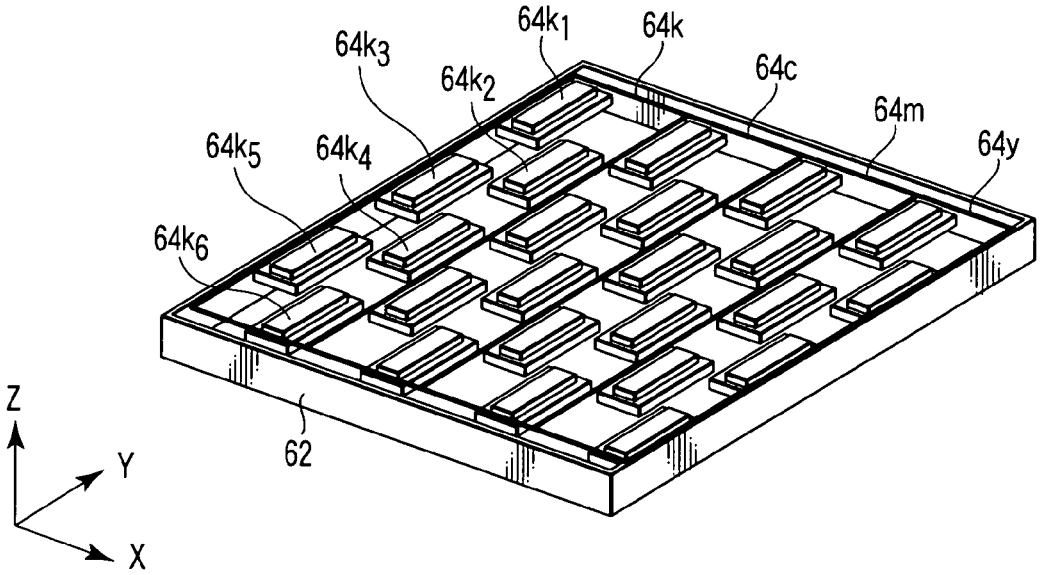
FIG. 3 is a diagram illustrating the arrangement of the suction caps of the cap unit used in the first embodiment.

As shown in, for example, FIG. 1B, the suction-cap units 64*k*, 64*c*, 64*m* and 64*y* cap the nozzle surfaces 54*k*, 54*c*, 54*m* and 54*y* of the ink-head units 52*k*, 52*c*, 52*m* and 52*y*, respectively. FIG. 3 shows the configuration of the suction-cap units 64*k*, 64*c*, 64*m* and 64*y*. The suction-cap unit 64*k*, for example, has six suction caps $\mathbf{64}k_1$ to $\mathbf{64}k_6$, which are arranged in two columns, each consisting of three suction caps such as to correspond respectively to the ink heads $\mathbf{52}k_1$ to $\mathbf{52}k_6$ of the ink-head unit 52*k*. The other suction-cap units 64*c*, 64*m* and 64*y* are similar in configuration to the suction-cap unit 64*k*.

The ink pan 62 holds ink dripped or removed from the ink-head units 52*k*, 52*c*, 52*m* and 52*y*. The cap unit 60 has a cap frame 66. The cap frame 66 is mounted on the belt unit 24. Thus, the cap unit 60 can move up and down in the direction of arrow Z, as the lift mechanism (not shown) drives the belt unit 24 up and down. The cap frame 66 supports the ink pan 62, which can move in the direction of arrow X when driven by an X-direction drive mechanism (not shown).

Thus, the ink pan 62 can move in the direction of arrow X, and the cap unit 60 can move up and down in the direction of arrow Z. Hence, the ink pan 62 can move to the following three positions. The first position is wait position A shown in FIG. 1A. The second position is capping position B shown in FIG. 1B. The third position is ink removal position C shown in FIG. 1C.

The wait position A is the position the cap unit 60 assumes when data such as an image is recorded on the recording medium 16. The capping position B is the position where the suction-cap units 64*k*, 64*c*, 64*m* and 64*y* cap the nozzle surfaces 54*k*, 54*c*, 54*m* and 54*y* of the ink-head units 52*k*, 52*c*, 52*m* and 52*y*, respectively. The ink removal position C is the position where wiper blades 70*k*, 70*c*, 70*m* and 70*y* remove ink from the nozzle surfaces 54*k*, 54*c*, 54*m* and 54*y* of the ink-head units 52*k*, 52*c*, 52*m* and 52*y*, respectively.

The cap unit 60 can be moved downwards from the wait position A (FIG. 1A) in the direction of arrow Z, when driven by the lift mechanism (not shown). Thereafter, the ink pan 62 is moved in the direction of arrow X by the X-direction drive mechanism (not shown). The suction-cap units 64*k*, 64*c*, 64*m* and 64*y* are thereby moved downwards into alignment with the ink-head units 52*k*, 52*c*, 52*m* and 52*y*, respectively.

Driven by the lift mechanism, the cap unit 60 moves up in the direction of arrow Z, reaching the capping position B shown in FIG. 1B. At this point, the suction-cap units 64*k*, 64*c*, 64*m* and 64*y* abut on the ink-head units 52*k*, 52*c*, 52*m* and 52*y*, respectively, as is illustrated in FIG. 1B. The suction-cap units 64*k*, 64*c*, 64*m* and 64*y* are connected to a suction pump (not shown) by ducts (not shown, either). The suction pump is driven, applying a suction force to the suction-cap units 64*k*, 64*c*, 64*m* and 64*y* through the ducts. As a result, the suction-cap units 64*k*, 64*c*, 64*m* and 64*y* draw ink from the ink-head units 52*k*, 52*c*, 52*m* and 52*y*, respectively. The suction pump collects the ink drawn from the ink-head units 52*k*, 52*c*, 52*m* and 52*y*, respectively. The ink thus collected will be discarded.

The ink pan 62 is connected to a waste-liquid tank (not shown) by a waste-liquid duct (not shown). The ink that has drip onto the ink pan 62 is collected in the waste-liquid tank.

Next, the lift mechanism moves the belt unit 24 downwards in the direction of arrow Z, to the ink removal position C shown in FIG. 1C, which is below the capping position B shown in FIG. 1B. The ink removal position C is a position where the cap unit 60 (i.e., suction-cap units 64*k*, 64*c*, 64*m* and 64*y*) does not interfere with the wiper unit 58 that has wiper blades 70*k*, 70*c*, 70*m* and 70*y*.

As shown in FIG. 1A, a control unit 72 is provided in the housing 10 of the ink-jet recording apparatus 1. The control unit 72 controls the driving of the pickup roller 18, registration rollers 20, belt unit 24, sheet ejection rollers 44, and the like. Further, the control unit 72 controls the sequence of recording data, such as an image, on the recording medium 16 fed by the belt unit 24, by causing the ink-head units 52*k*, 52*c*, 52*m* and 52*y* to eject inks to the recording medium 16. The control unit 72 also controls the sequence of clearing the ink-head units 52*k*, 52*c*, 52*m* and 52*y*. The control unit 72 is shown in FIG. 1A only, not shown in FIG. 1B or FIG. 1C for the simplicity of illustration.

Figure 4:
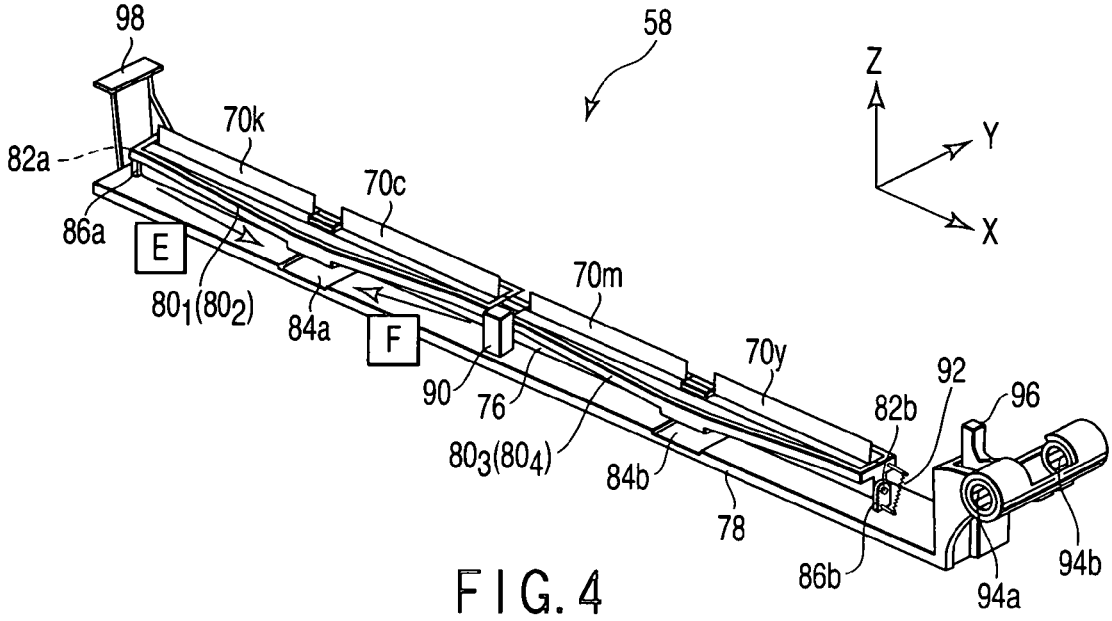
FIG. 4 is a diagram showing, in detail, the wiper unit provided in the first embodiment.

The wiper unit 58 will be described in detail, with reference to FIG. 4. As shown in FIG. 4, the wiper unit 58 has wiper blades 70*k*, 70*c*, 70*m* and 70*y*, a blade holder 76, and a wiper holder 78. The wiper blades 70*k*, 70*c*, 70*m* and 70*y* are provided in association with the ink-head units 52*k*, 52*c*, 52*m* and 52*y*, respectively. The blade holders 76 hold the wiper blades 70*k*, 70*c*, 70*m* and 70*y*. The wiper holder 78 holds the blade holder 76.

The wiper blades 70*k*, 70*c*, 70*m* and 70*y* are elastic material members that are made of rubber or resin. The wiper blades 70*k*, 70*c*, 70*m* and 70*y* are installed one by one for one color.

Ink guides $\mathbf{80}_1$, $\mathbf{80}_2$, $\mathbf{80}_3$ and $\mathbf{80}_4$ are provided on the blade holder 76. In FIG. 4, only the ink guides $\mathbf{80}_1$, and $\mathbf{80}_3$ are shown. The other ink guides $\mathbf{80}_2$, and $\mathbf{80}_4$ are not shown in detail, which are similar in configuration to the ink guides $\mathbf{80}_1$ and $\mathbf{80}_3$, are provided on that side of the blade holder 76, which is opposite to the side on which the ink guides $\mathbf{80}_1$ and $\mathbf{80}_3$ are provided. The ink guides $\mathbf{80}_1$, $\mathbf{80}_2$, $\mathbf{80}_3$ and $\mathbf{80}_4$ incline downwards so that the ink removed by the wiper blades 70*k*, 70*c*, 70*m* and 70*y* may flow down by its weight, in the direction of arrow E and F.

Ink-absorbing pads 84*a* and 84*b* are provided on the wiper holder 78, in order to recover the ink coming along the ink guides $\mathbf{80}_1$, $\mathbf{80}_2$, $\mathbf{80}_3$ and $\mathbf{80}_4$. Thus, the ink removed by the wiper blades 70*k*, 70*c*, 70*m* and 70*y* and guided by the ink guides $\mathbf{80}_1$, $\mathbf{80}_2$, $\mathbf{80}_3$ and $\mathbf{80}_4$ is all recovered by the ink-absorbing pads 84*a* and 84*b*. Wiper shafts 82*a* and 82*b* are provided on those sides of the blade holder 76, which extend in the lengthwise direction thereof.

On the wiper holder 78, support members 86*a* and 86*b* are provided, supporting the wiping shafts 82*a* and 82*b* and allowing the wiping shafts 82*a* and 82*b* to rotate with respect to the wiper holder 78. Therefore, the blade holder 76 is supported, able to rotate with respect to the wiper holder 78. The angle through which the blade holder 76 can rotate is limited by a stopper 90, which stands on the wiper holder 48 and which extends in the direction of arrow Z.

A spring 92 is stretched between one end of the blade holder 76 and the support member 86*a* provided on the wiper holder 78. Similarly, another spring 92 is stretched between the other end of the blade holder 76 and the support member 86*b*. Both springs 92 bias the blade holder 76 toward the stopper 90 that is provided on the wiper holder 78.

Bushes 94*a* and 94*b* and a belt holder 96 are provided at one end of the wiper holder 78. A guide hook 98 is provided at the other end of the wiper holder 78, as viewed in the lengthwise direction of the wiper holder 78. The wiper unit 58 is held to head holder 50 by the bushes 94*a*, 94*b* and the guide hook 98. The belt holder 96 holds a belt 114, which will be described later. As the belt 114 moves, the wiper unit 58 is moved.

How the wiper unit 58 is held to the head holder 50, and how the wiper unit 58 is moved in the direction of arrow Y will be explained, with reference to FIGS. 5 and 6.

Figure 5:
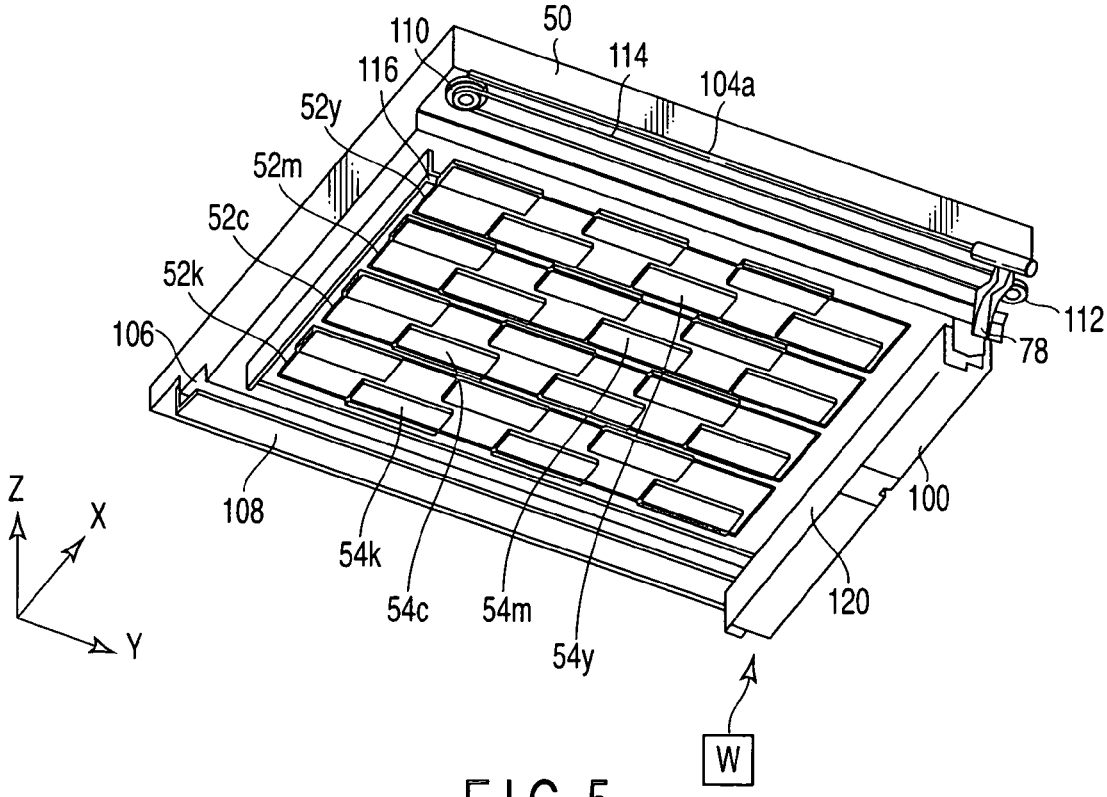
FIG. 5 is a diagram showing the head holder used in the first embodiment, as obliquely viewed from below.

FIG. 5 is a diagram showing the head holder 50 as obliquely viewed from below. FIG. 6 is a diagram showing, in detail, the path in which the wiper unit 58 moves. Note that FIGS. 5 and 6 illustrate the wiper unit 58 that stays at wait position W in a wiper storage 100 as an accommodation unit. The wiper storage 100 will be described later.

As shown in FIG. 5, a guide shaft 104*a* is fixed to the head holder 50. The guide shaft 104*a* lies downstream with respect to the direction of transporting the recording medium 16 and extends parallel to the nozzles columns of the ink-head units 52*k*, 52*c*, 52*m* and 52*y*.

The guide shaft 104*a* holds the bushes 94*a* and 94*b* that are provided at the one end of the wiper holder 78, allowing the bushes 94*a* and 94*b* to slide.

A guide groove 106 is cut in the head holder 50. The guide groove 106 lies upstream of the head holder 50, with respect to the direction of transporting the recording medium 16, and extends parallel to the nozzle columns of the ink-head units 52*k*, 52*c*, 52*m* and 52*y*. A guide plate 108 is secured to the head holder 50, opposed to the guide groove 106. Hence, a gap (space) is provided between the guide groove 106 and the guide plate 108.

The guide hook 98 formed at the other end of the wiper holder 78 described above is held between the guide groove 106 cut in the head holder 50 and the guide plate 108 secured to the head holder 50. Therefore, the guide hook 98 is prevented from moving in the direction of arrow Z. Thus, the guide shaft 104*a* and the guide plate 108, both secured to the head holder 50, hold the ends of the wiper holder 78 (and, hence, wiper unit 58), allowing the wiper holder 78 to move in the direction of arrow Y.

Figure 6:
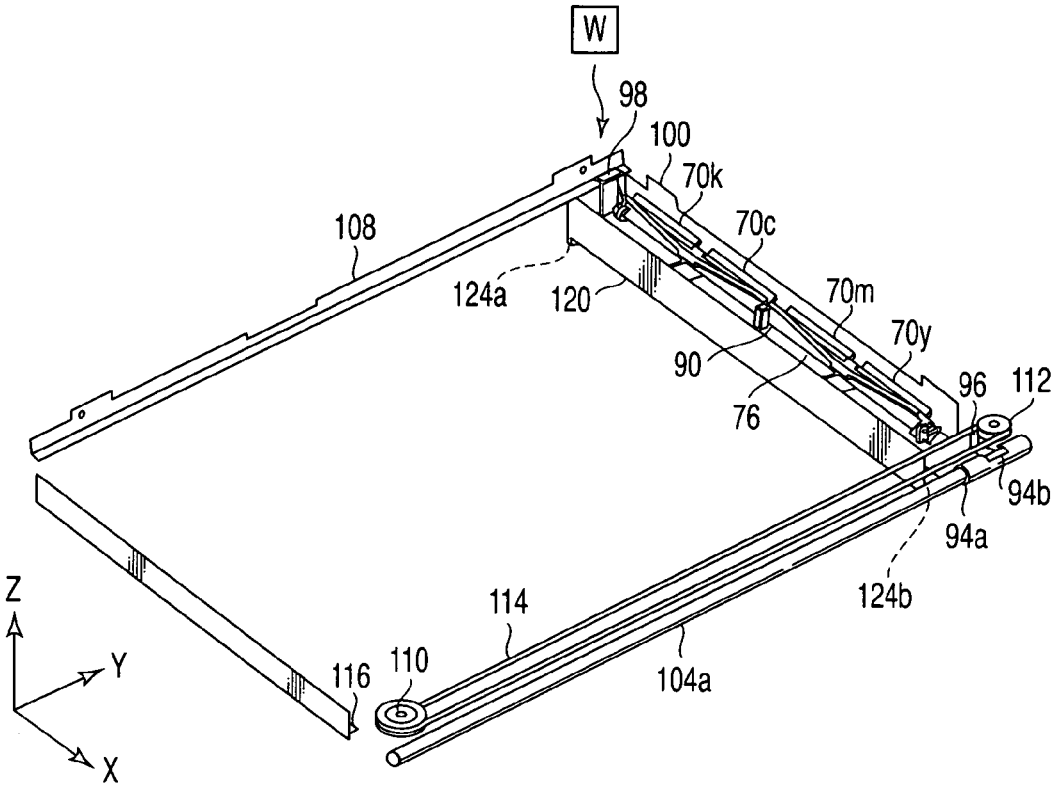
FIG. 6 is a diagram showing, in detail, the path in which the wiper unit moves in the first embodiment.

As shown in FIGS. 5 and 6, a pulley 110 is provided at that end of the head holder 50, which lies downstream with respect to the direction of transporting the recording medium 16. The pulley 110 is coupled to the wiping motor 56. Another pulley 112 is provided, opposing the pulley 110, across the ink-head units 52*k*, 52*c*, 52*m* and 52*y*. A belt 114 is wrapped around the pulleys 110 and 112.

When driven, the wiping motor 56 generates a drive force, which is transmitted to the pulley 110. The pulley 110 is thereby rotated, driving the belt 114.

Hence, the belt 114 runs between the pulleys 110 and 112. As the belt 114 runs so, the wiper holder 78 (wiper unit 58), which is fastened to the belt 114 by the belt holder 96, moves back and forth in the direction of arrow Y, while the guide hook 98 and the pushes 94*a* and 94*b* are sliding on the guide plate 108 and the guide shaft 104*a*. At that time, a reverse guide 116, provided in a reversing position L opposite to the wait position W in the lengthwise direction of the ink-head unit, changes the angle of inclination of the blade holder 76 (wiper blades 70*k*, 70*c*, 70*m* and 70*y*).

The wiper storage 100 will be described with reference to FIGS. 7 and 8.

Figure 7:
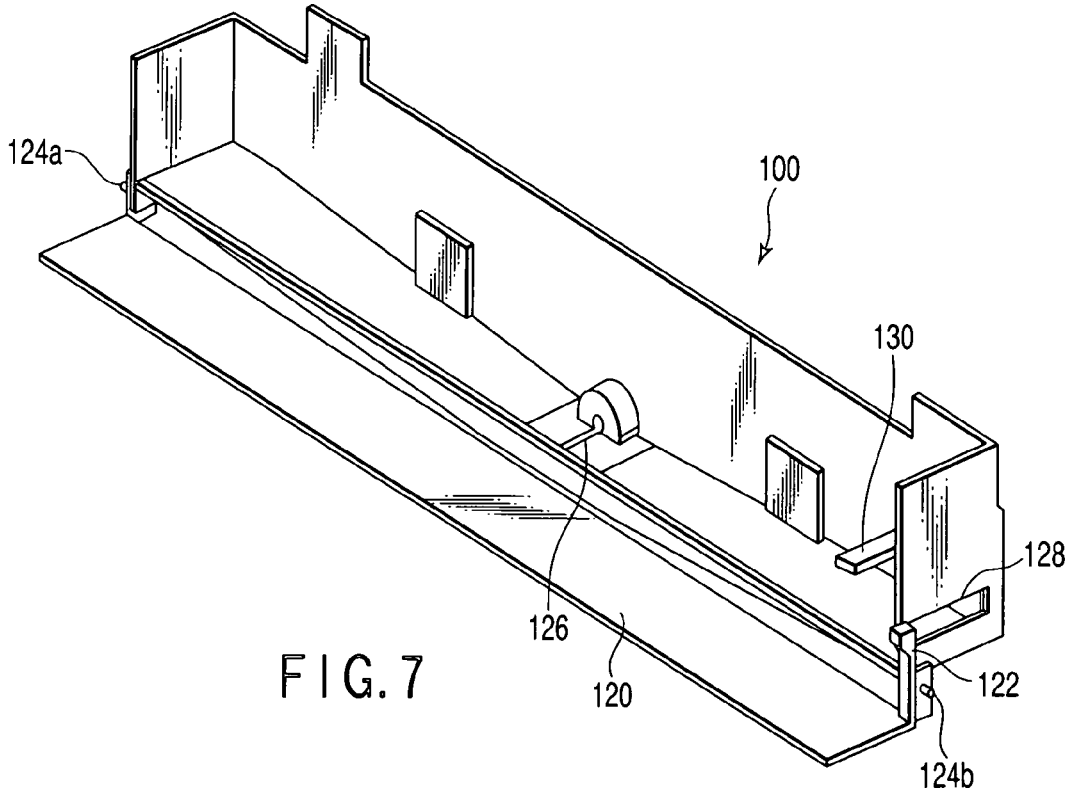
FIG. 7 is a perspective view illustrating only the wiper storage provided in the first embodiment.

FIG. 7 is a perspective view illustrating the wiper storage 100 only. FIG. 8 is a view representing the positional relation that the head holder 50, cap unit 60, belt unit 24 and wiper storage 100, as viewed from one side of the ink-jet recording apparatus 1.

As shown in FIG. 7, a cover 120 is provided for the wiper storage 100. An opening/closing guide 122 is provided on one end of the cover 120 (or the side near the guide shaft 104*a*), with respect to the lengthwise direction of the cover 120. The cover 120 is rotatably supported, at both ends, by cover shafts 124*a* and 124*b*. The cover 120 can therefore rotate between the opened position shown in FIG. 7 and the closed position shown in FIG. 6.

The bottom of the wiper storage 100 is inclined and has a waste liquid port 126 in the center or lowest part. The waste liquid port 126 communicates with the waste liquid recovery tank (not shown). The ink dripping from the wiper unit 58 therefore flows via the waste liquid port 126 into the waste liquid recovery tank. Further, the wiper storage 100 has an opening 128 at one end (or in the side near the guide shaft 104*a*), with respect to its lengthwise direction. The wiper holder 78 enters this opening 128, whereby the wiper unit 58 is held within the wiper storage 100. The wiper storage 100 has a reverse guide 130, which can change the angle of inclination of the blade holder 76 (wiper blades 70*k*, 70*c*, 70*m* and 70*y*).

Figure 8:
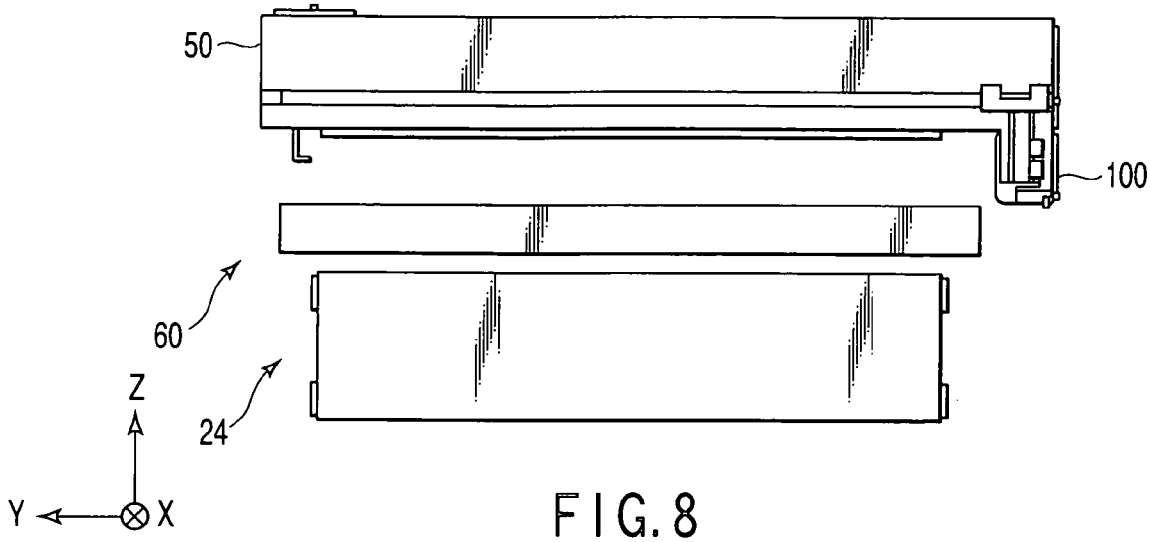
FIG. 8 is a side view representing the positional relation that the head holder, cap unit, belt unit and wiper storage have in the first embodiment.

As shown in FIG. 8, the wiper storage 100 configured as described above is arranged outside the zone in which ink is ejected from the ink-head units 52*k*, 52*c*, 52*m* and 52*y*. More specifically, the wiper storage 100 is arranged at one end of a line extended from the ink-head units 52*k*, 52*c*, 52*m* and 52*y* in the lengthwise direction thereof outside the projected area of the ink-head units 52*k*, 52*c*, 52*m* and 52*y*. Preferably, the wiper storage 100 should be arranged outside the projected area of the belt unit 24. This would prevent ink from adhering to the belt of the belt unit 24 even if the ink drips from the wiper storage 100.

The state that the wiper unit 58 assumes at the wait position W and the reversing position L will be explained, with reference to FIGS. 9 to 12.

Figure 9:
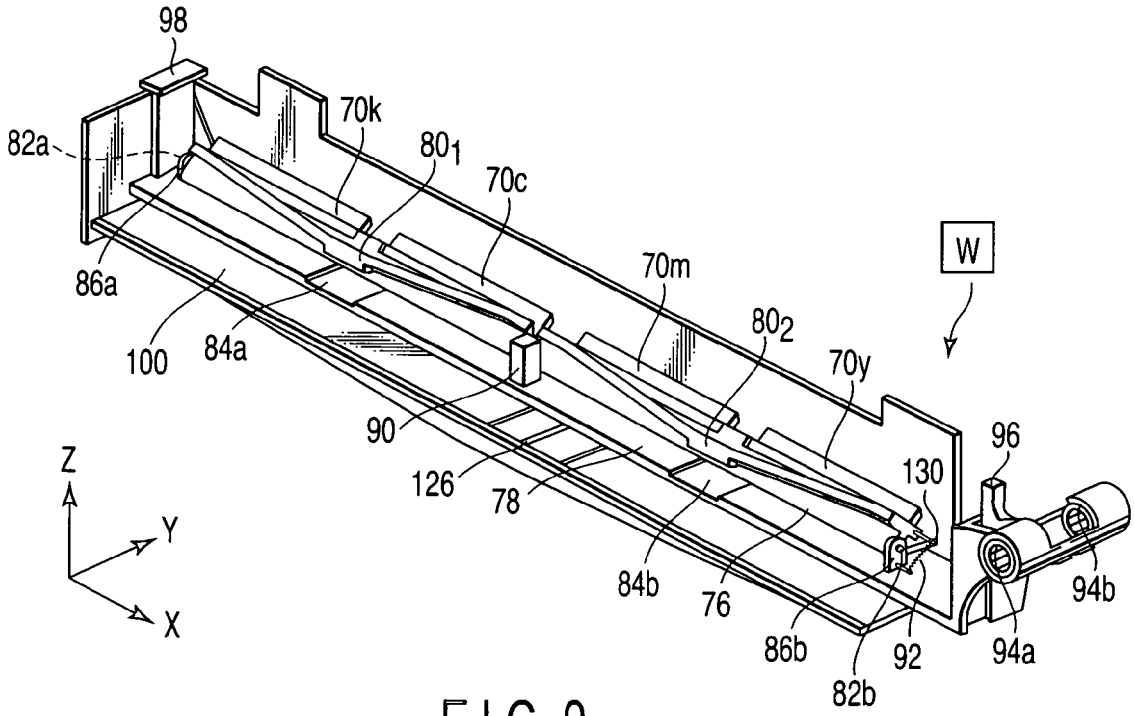
FIG. 9 is a diagram depicting the posture of the wiper holder in the wait position W, in the first embodiment.
Figure 10:
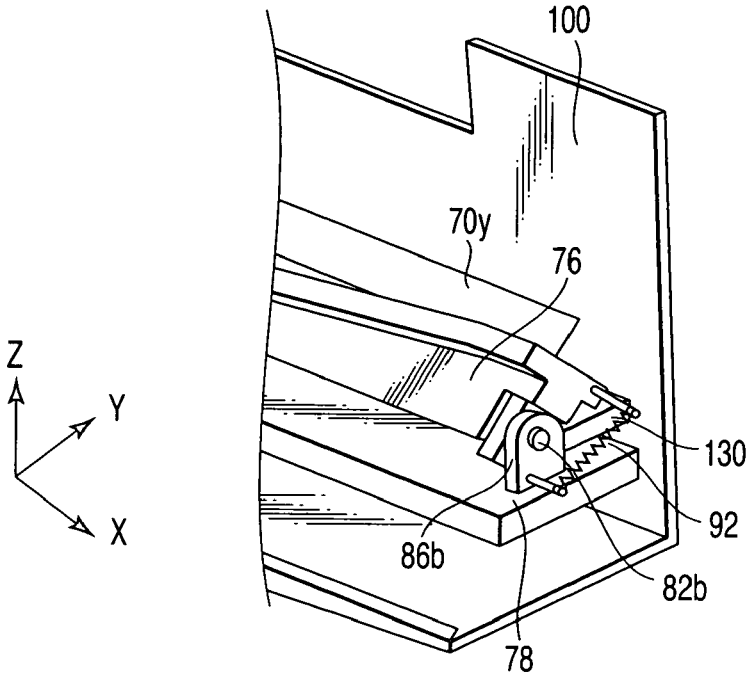
FIG. 10 is a partial view depicting the posture of the blade holder in the wait position W, in the first embodiment.
Figure 11:
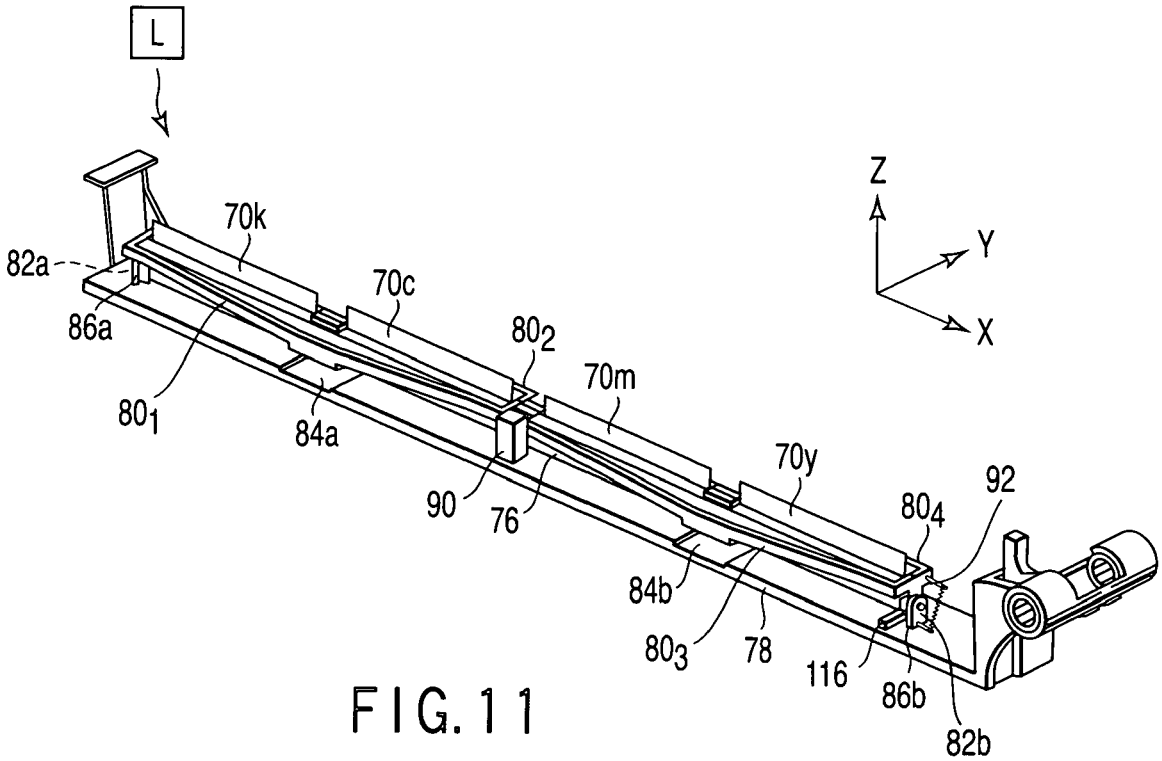
FIG. 11 is a diagram depicting the posture of wiper holder in the reversing position L in the first embodiment.
Figure 12:
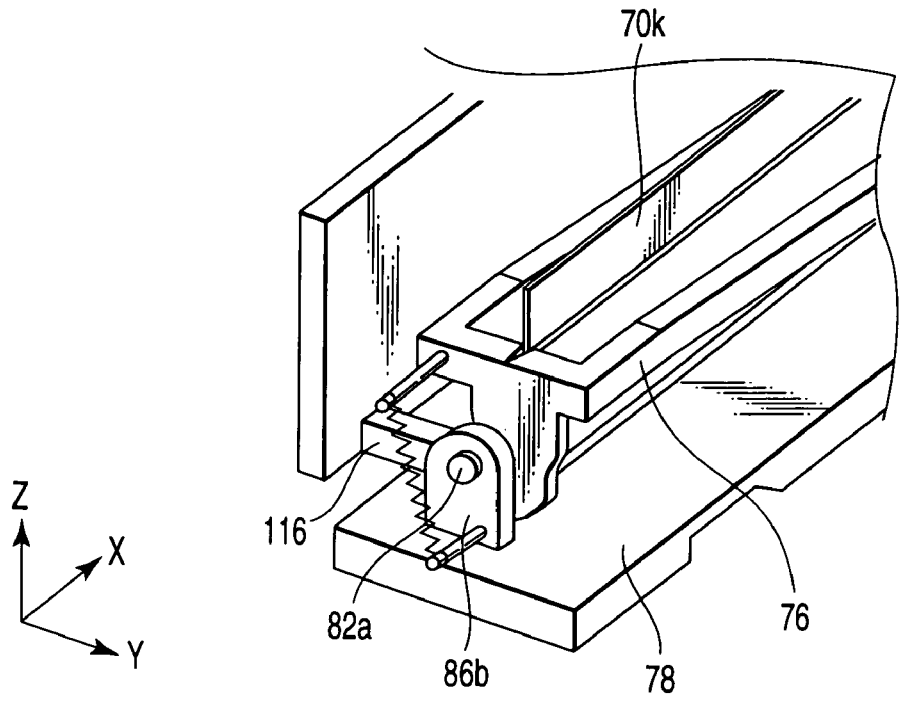
FIG. 12 is a partial view depicting the posture of the blade holder in the reversing position L in the first embodiment.

FIG. 9 is a diagram depicting the state the wiper holder 78 and the blade holder 76 assume at the wait position W. In FIG. 9, the cover 120 is not shown for the sake of simplicity of illustration. FIG. 10 is a partial view showing the wiper holder 78 and the blade holder 76, both staying at the wait position W. FIG. 11 is a diagram depicting the state the wiper holder 78 and the blade holder 76 assume at the reversing position L. FIG. 12 is a partial view depicting the position the wiper holder 78 and the blade holder 76, both staying at the reversing position L.

When the wiper holder 78 enters the wiper storage 100 and reaches the wait position W as shown in FIGS. 9 and 10, the lower part of the blade holder 76 abuts on the reverse guide 130. The blade holder 76 rotates around the wiping shafts 82*a* and 82*b* and is therefore inclined in posture. At this point, the blade holder 76 abuts on the lower part of the stopper 90, thus restricting the inclination of the wiper blades 70*k*, 70*c*, 70*m* and 70*y*. The wiper blades 70*k*, 70*c*, 70*m* and 70*y* are inclined at such an angle that the wiper blades 70*k*, 70*c*, 70*m* and 70*y* may not touch the nozzle surfaces 54*k*, 54*c*, 54*m* and 54*y*, respectively. Further, two springs 92 are stretched, extending in the direction of arrow X, respectively between one end of the blade holder 76 and the support member 86*a* and between the other end of the blade holder 76 and the support member 86*b*. This keeps the blade holder 76 held biased onto the stopper 90.

When the wiper holder 78 reaches the reversing position L as shown in FIGS. 11 and 12, the lower part of the blade holder 76 abuts on the reverse guide 116. The blade holder 76 is then rotated in the opposite direction around the wiping shafts 82*a* and 82*b*, from the wait position W. At this time, the blade holder 76 abuts on the upper part of the stopper 90. Hence, the blade holder 76 is held so inclined that the wiper blades 70*k*, 70*c*, 70*m* and 70*y* extend at right angles to the nozzle surfaces 54*k*, 54*c*, 54*m* and 54*y*, respectively. At this point, the blade holder 76 is held biased onto the stopper 90 by the two springs 92 that are stretched between the wiper holder 78, on the one hand, and the support members 86*a* and 86*b*, on the other.

Thus, the blade holder 76 and the wiper holder 78 are inclined at a specific angle to prevent the wiper blades 70*k*, 70*c*, 70*m* and 70*y* from contacting the nozzle surfaces 54*k*, 54*c*, 54*m* and 54*y* when it moves from the wait position W to the reversing position L, respectively. When the blade holder 76 moves back from the reversing position L to the wait position W, it is inclined at another specific angle to allow the wiper blades 70*k*, 70*c*, 70*m* and 70*y* to contact the nozzle surfaces 54*k*, 54*c*, 54*m* and 54*y*, respectively.

How the ink-jet recording apparatus 1 so configured as described above operates to record images will be explained.

The control unit 72 drives the pickup roller 18, registration rollers 20, belt unit 24 and sheet ejection rollers 44. The recording medium 16 are thereby picked up, one after another, from the sheet-feeding tray 14. The medium 16 are then fed to the registration rollers 20, one after another. The registration rollers 20 adjust the timing of transporting each recording medium 16 onto the belt 34 of the belt unit 24. After adjusting this timing, the registration rollers 20 feed the recording medium 16 onto the belt 34.

The belt unit 24 drives the belt 34 as one of the platen rollers 28 to 32, e.g., platen roller 30 coupled to a drive motor, rotates. Since the suction fan 38 of the belt unit 24 is driven at this time, the suction force the fan 38 generates is applied to the recording medium 16 laid on the belt 34 through the many holes made in the platen 36 and belt 34. The recording medium 16 is thereby attracted to, and held on, the belt 34. As the belt 34 is driven, the recording medium 16 is transported forward.

Eventually, the recording medium 16 arrives at a position below the ink-head units 52*k*, 52*c*, 52*m* and 52*y*. The ink-head units 52*k*, 52*c*, 52*m* and 52*y* sequentially operate, ejecting black ink, cyan ink, magenta ink and yellow ink, respectively, through the nozzles that are made in the nozzle surfaces 54*k*, 54*c*, 54*m* and 54*y*. The droplets ejected reach the recording surface of the medium 16, recording an image on the recording medium 16.

The sheet ejection rollers 44 eject the recording medium 16, on which an image has been recorded, from the housing 10 of the ink-jet recording apparatus 1.

As the apparatus 1 keeps recording images, paper dust may rise from the medium 16, the viscosity of ink may increase, or bubbles may develop in the ink. The paper dust, the increase in ink viscosity, or the bubbles may result in faulty ink ejection at the nozzles of the ink-head units 52*k*, 52*c*, 52*m* and 52*y*.

To avoid such faulty ink ejection, the nozzle surfaces 54*k*, 54*c*, 54*m* and 54*y* of the ink-head units 52*k*, 52*c*, 52*m* and 52*y* are cleaned. The cleaning is performed every time data (e.g., images) is recorded on a preset number of recording medium 16, or every time a preset period elapses.

How the cleaning is performed in the ink-jet recording apparatus 1 so configured as described above will be explained below.

To commence the cleaning, the lift mechanism moves the belt unit 24 down. As the belt unit 24 is moved down, the lift mechanism lowers the cap unit 60 to a level, where the suction-cap units 64*k*, 64*c*, 64*m* and 64*y* of the cap unit 60 lie below the nozzle surfaces 54*k*, 54*c*, 54*m* and 54*y* of the ink-head units 52*k*, 52*c*, 52*m* and 52*y*.

Thereafter, the ink pan 62 is moved, thereby aligning the suction-cap units 64*k*, 64*c*, 64*m* and 64*y* with the nozzle surfaces 54*k*, 54*c*, 54*m* and 54*y*, respectively. The lift mechanism is then driven, lifting the belt unit 24 again. The suction-cap units 64*k*, 64*c*, 64*m* and 64*y* are thereby brought into contact with the ink-head units 52*k*, 52*c*, 52*m* and 52*y*, respectively.

When the suction-cap units 64*k*, 64*c*, 64*m* and 64*y* contact the ink-head units 52*k*, 52*c*, 52*m* and 52*y*, the cap unit 60 is made to stop moving upwards. Then, the suction pump is driven, generating the suction force. The suction force is applied via the ducts (not shown) to the gaps between the suction-cap units 64*k*, 64*c*, 64*m* and 64*y*, on the one hand, and the nozzle surfaces 54*k*, 54*c*, 54*m* and 54*y*, on the other hand. As a result, a negative pressure develops in these gaps. The negative pressure forces out foreign matter (e.g., paper dust) and the ink, through the nozzles made in the nozzle surfaces 54*k*, 54*c*, 54*m* and 54*y*.

After the foreign matter and the ink have been forced out, the lift mechanism lowers the cap unit 60, together with the belt unit 24. As a result, a space in which the wiper unit 58 can operate is provided between the cap unit 60 and the ink-head units 52*k*, 52*c*, 52*m* and 52*y*. The wiper holder 78 lies at the wait position W as long as the wiper unit 58 remains to operate. At this wait position W, the wiper blades 70*k*, 70*c*, 70*m* and 70*y* are held inclined, respectively, to the nozzle surfaces 54*k*, 54*c*, 54*m* and 54*y* of the ink-head units 52*k*, 52*c*, 52*m* and 52*y*.

When the wiping motor 56 provided in the wiper unit 58 is driven in forward direction, the pulley 110 coupled to the wiping motor 56 is rotated. The belt 114 is thereby driven between the pulleys 110 and 112. The wiper holder 78 is fastened to the belt 114 by the belt holder 96. The wiper holder 78 therefore moves from the wait position W to the reversing position L as the belt 114 is driven. At this point, the wiper holder 78 is guided, at one end, by the bushes 94*a* and 94*b* associated with the guide shaft 104*a*. At the other end, the wiper holder 78 is guided by a guide hook 98 associated with the guide plate 108.

Figure 13:
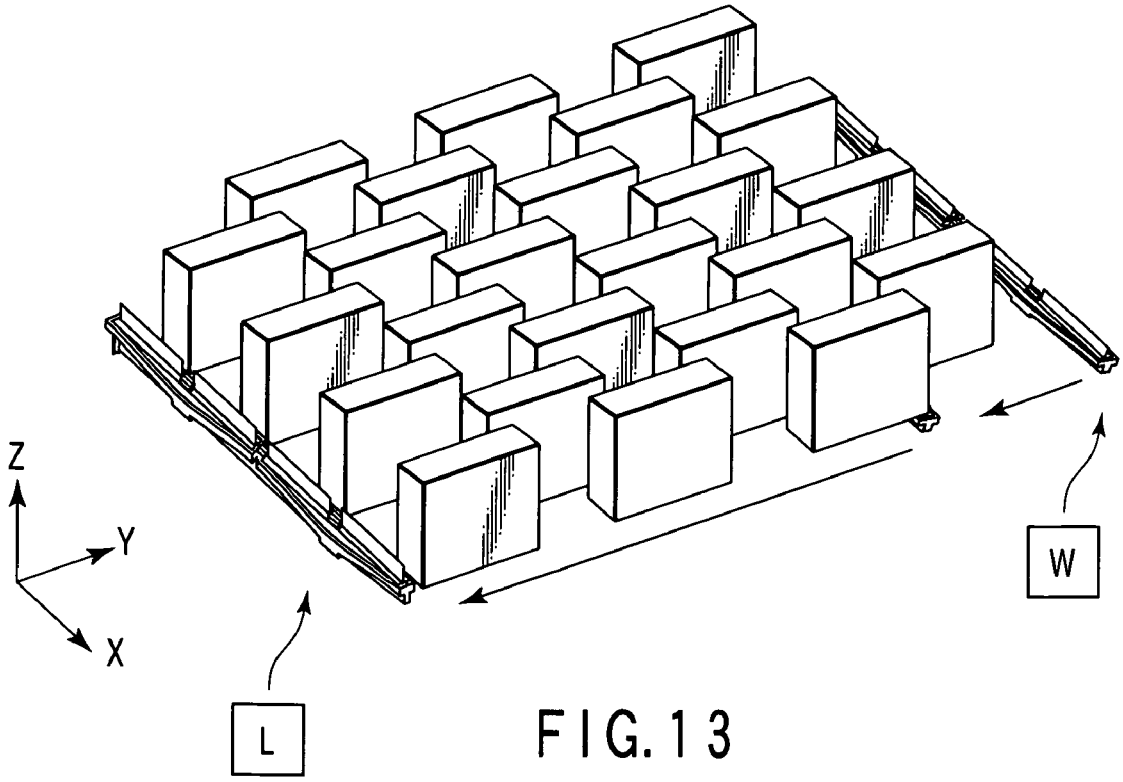
FIG. 13 is a diagram illustrating the wiper blades moving from the wait position W toward the reversing position L in the first embodiment.
Figure 14:
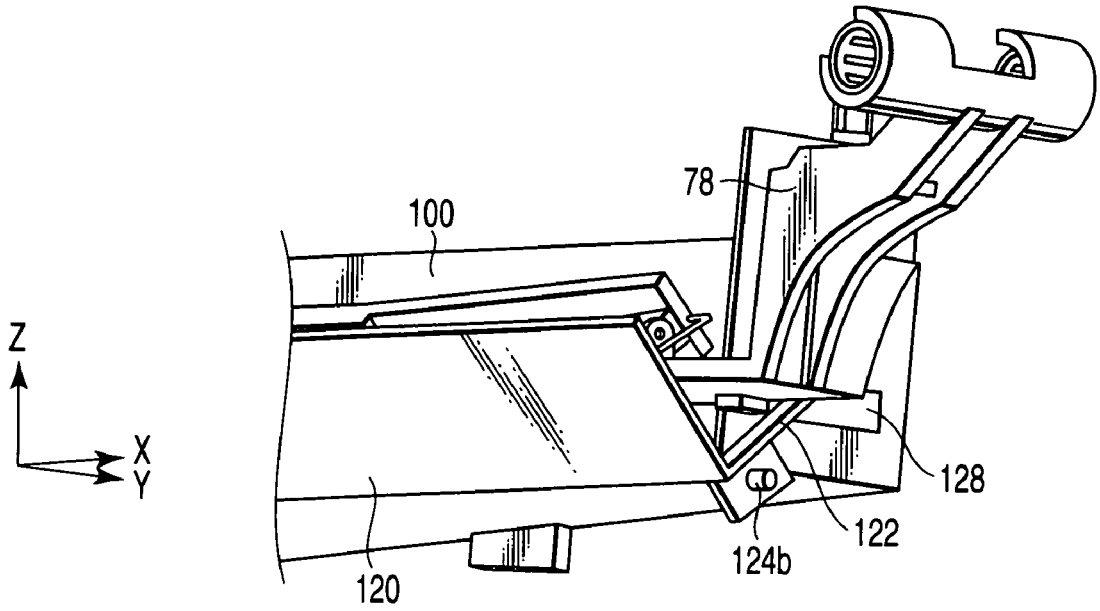
FIG. 14 is a diagram illustrating how a cover is opened as the wiper holder moves in the first embodiment.
Figure 15:
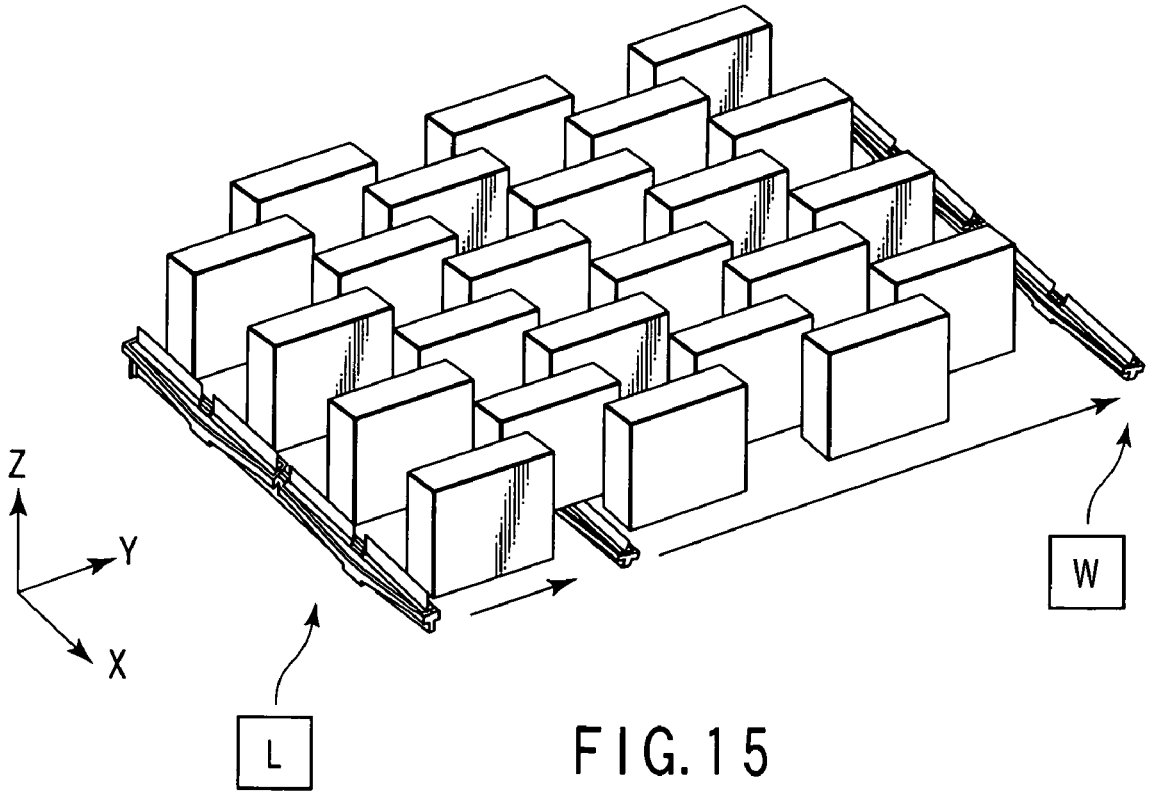
FIG. 15 is a diagram illustrating how the wiper blades moving from the reversing position L toward the wait position W in the first embodiment.

FIG. 13 shows how each wiper holder 78 moves from the wait position W to the reversing position L. FIG. 14 shows how the wiper holder 78 moves out of the wiper storage 100.

The wiper holder 78 moves from the wiper storage 100 and abuts on the cover 120 as is illustrated in FIG. 14. Thus, the cover 120 is opened, rotating around the cover shafts 124*a* and 124*b*. At this time, the wiper blades 70*k*, 70*c*, 70*m* and 70*y* are held at such an angle as not to touch the nozzle surfaces 54*k*, 54*c*, 54*m* and 54*y* of the ink-head units 52*k*, 52*c*, 52*m* and 52*y*. Hence, the wiper blades 70*k*, 70*c*, 70*m* and 70*y* move to the reversing position L, without contacting the nozzle surfaces 54*k*, 54*c*, 54*m* and 54*y*.

When the wiper holder 78 reaches the reversing position L, the blade holder 76 supported by the wiper holder 78 abuts, at the lower part, on the reverse guide 116. As a result, the blade holder 76 rotates around the wiping shafts 82*a* and 82*b* and abuts, at one end, on the upper edge of the stopper 90. At this time, the springs 92 bias the blade holder 76 toward the stopper 90. The blade holder 76 therefore holds the wiper blades 70*k*, 70*c*, 70*m* and 70*y* at right angles, respectively, to the nozzle surfaces 54*k*, 54*c*, 54*m* and 54*y* of the ink-head units 52*k*, 52*c*, 52*m* and 52*y*. At this time, the wiper blades 70*k*, 70*c*, 70*m* and 70*y* lie at the positions where they contact, respectively, the nozzle surfaces 54*k*, 54*c*, 54*m* and 54*y* of the ink-head units 52*k*, 52*c*, 52*m* and 52*y*.

On the other hand, when the wiper holder 78 moves to the reversing position L, the wiping motor 56 is driven in reverse direction. As the wiping motor 56 is so driven, the wiper holder 78 moves from the reversing position L toward the wait position W. As the wiper holder 78 moves so, the wiper blades 70*k*, 70*c*, 70*m* and 70*y* moves, in contact with the nozzle surfaces 54*k*, 54*c*, 54*m* and 54*y*, while being held at right angles to the nozzle surfaces 54*k*, 54*c*, 54*m* and 54*y* of the ink-head units 52*k*, 52*c*, 52*m* and 52*y*.

The wiper blades 70*k*, 70*c*, 70*m* and 70*y* therefore remove ink from the nozzle surfaces 54*k*, 54*c*, 54*m* and 54*y* of the ink-head units 52*k*, 52*c*, 52*m* and 52*y*. The ink, thus removed, flows by its weight from the wiper blades 70*k*, 70*c*, 70*m* and 70*y* to the blade holder 76. The ink is guided by the ink guides $\mathbf{80}_1$, $\mathbf{80}_2$, $\mathbf{80}_3$ and $\mathbf{80}_4$ that are provided on the blade holder 76. Therefore, the ink is ultimately absorbed into the ink-absorbing pads 84*a* and 84*b* that are provided on the wiper holder 78.

Figure 16:
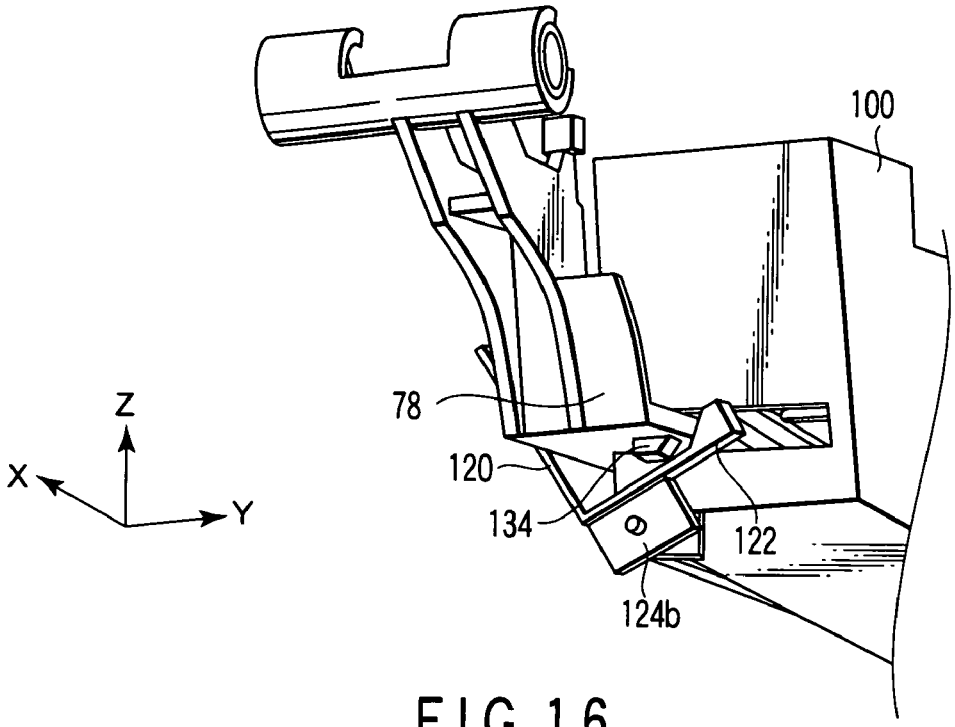
FIG. 16 is a diagram illustrating how the cover is closed as the wiper holder moves in the first embodiment.
Figure 17:
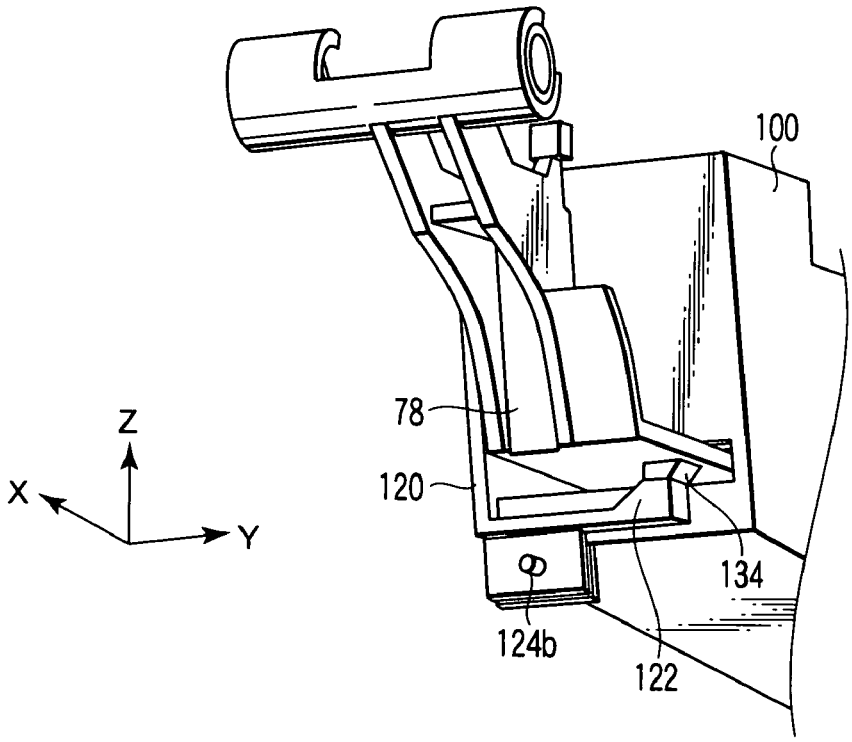
FIG. 17 is a diagram showing the cover closed in the first embodiment.

FIGS. 16 and 17 illustrate how the wiper holder 78 returns into the wiper storage 100. As the wiper holder 78 is stored into the wiper storage 100, it contacts the opening/closing guide 122 provided on one end of the cover 120. As a result, the cover 120 rotates around the cover shafts 124*a* and 124*b* and is gradually closed. Finally, a projection 134 of the wiper holder 78 located in the position corresponding to the opening/closing guide 122 is brought into contact with the opening/closing guide 122, so that the cover 120 is maintained in a closed state.

Then, the lower part of the blade holder 76 held by the wiper holder 78 abuts on the reverse guide 130. The blade holder 76 therefore rotates around the wiping shafts 82*a* and 82*b*. As a result, the blade holder 76 abuts, at one side, on the lower part of the stopper 90. At this point, the blade holder 76 is biased by the sprints 92 toward the stopper 90. The wiper blades 70*k*, 70*c*, 70*m* and 70*y* are thereby inclined to such an angle that they may not touch the nozzle surfaces 54*k*, 54*c*, 54*m* and 54*y*, as the wiper holder 78 moves from the wait position W to the reversing position L.

When the wiper holder 78 stops at the wait position W, the ink-absorbing pads 84*a* and 84*b*, which are provided on the wiper holder 78, abut on one side of the wiper storage 100. The ink-absorbing pads 84*a* and 84*b* are therefore compressed. The ink is thereby squeezed from the ink-absorbing pads 84*a* and 84*b*. The ink flows down on the sides of the wiper storage 100 to the bottom thereof. Since the bottom of the wiper storage 100 inclines, the ink is guided into the waste liquid port 126 and then flows into the waste liquid recovery tank (not shown).

After the wiper holder 78 has stopped at the wait position W, the ink pan 62 is moved from the position where it opposes the nozzle surfaces 54*k*, 54*c*, 54*m* and 54*y*. The lift mechanism therefore moves the belt unit 24 upwards to a position (i.e., wait position A) where the ink-head units 52*k*, 52*c*, 52*m* and 52*y* can form an image on the recording medium 16.

The head holder 50 holds the wiper unit 58 in the first embodiment. The wiper blades 70*k*, 70*c*, 70*m* and 70*y* can therefore be slid on the nozzle surfaces 54*k*, 54*c*, 54*m* and 54*y*, respectively, without the necessity of changing the positions the wiper blades 70*k*, 70*c*, 70*m* and 70*y* have relative to the nozzle surfaces 54*k*, 54*c*, 54*m* and 54*y*.

Hence, the ink-jet recording apparatus 1 according to the present embodiment can more reliably operate than the conventional ink-jet recording apparatus in which the cap unit holds the wiper unit and the positions the wiper blades have relative to the nozzle surfaces of the ink-head units are controlled. That is, in the apparatus 1, the wiper blades 70*k*, 70*c*, 70*m* and 70*y* can reliably and stably remove ink from the nozzle surfaces 54*k*, 54*c*, 54*m* and 54*y* of the ink-head units 52*k*, 52*c*, 52*m* and 52*y*.

Further, the wiper unit 58 would not hinder the image-recording because the wiper storage 100 containing the wiper unit 58 is provided outside the belt unit 24 that feeds the recording media. The belt unit 24 can therefore be positioned near the ink-head units 52*k*, 52*c*, 52*m* and 52*y*. This achieves reliable and stable application of ink to recording medium 16.

Moreover, foreign matter, such as paper dust, can be prevented from adhering to the wiper blades 70*k*, 70*c*, 70*m* and 70*y*, because the wiper storage 100 accommodate the wiper unit 58 during the image-recording. Thus, the wiper blades 70*k*, 70*c*, 70*m* and 70*y* can remove ink from the nozzle surfaces 54*k*, 54*c*, 54*m* and 54*y*, always rendering these surfaces clean.

As long as the wiper blades 70*k*, 70*c*, 70*m* and 70*y* are removing ink from the nozzle surfaces 54*k*, 54*c*, 54*m* and 54*y*, the ink pan 62 of the cap unit 60 stays above the belt unit 24. Therefore, ink never adhere to the belt unit 24 even if it drips from the ink-head units 52*k*, 52*c*, 52*m* and 52*y* or the wiper unit 58. Thus, no ink will be unnecessarily applied to the recording medium 16.

As indicated above, the ink guides $\mathbf{80}_1$, $\mathbf{80}_2$, $\mathbf{80}_3$ and $\mathbf{80}_4$ are provided on the blade holder 76. Therefore, the ink guides $\mathbf{80}_1$, $\mathbf{80}_2$, $\mathbf{80}_3$ and $\mathbf{80}_4$ guide the ink removed by the wiper blades 70*k*, 70*c*, 70*m* and 70*y* to a part of the apparatus. The ink flows along the ridge of the part of the apparatus. This prevents the apparatus from being contaminated with ink.

In the embodiment described above, one wiper blade is provided for two columns of ink heads that eject ink of the same color. The configuration of the apparatus is not limited to this. One wiper blade may be provided for each column of ink heads.

Second Embodiment

A second embodiment of the present invention will be described with reference to some figures.

The second embodiment is identical in basic configuration and basic operation to the first embodiment shown in FIGS. 1A to 1C and FIGS. 2 to 17. Therefore, the components identical to those of the first embodiment are designated by the same reference numbers and will not be described. The operations identical to those performed by the first embodiment will not be described, either. Only the components and operations that differ from those of the first embodiment will be described.

Figure 18A:
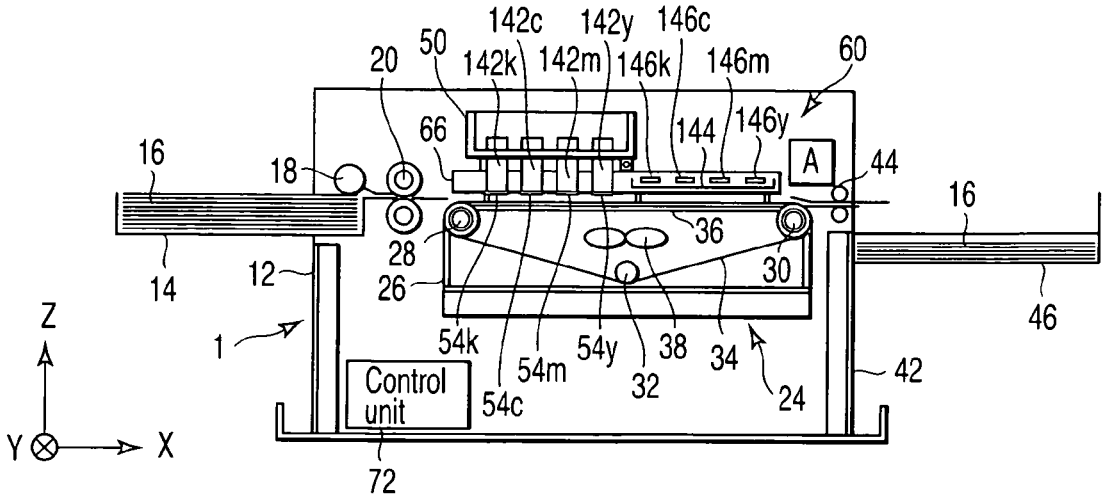
FIGS. 18A to 18C are diagrams showing the overall configuration of an ink-jet recording apparatus according to a second embodiment of this invention, FIG. 18A depicting the cap unit held at the wait position, FIG. 18B depicting the cap unit held at the ink-drawing position, and FIG. 18C depicting the wiper unit held at the ink removal position.
Figure 18B:
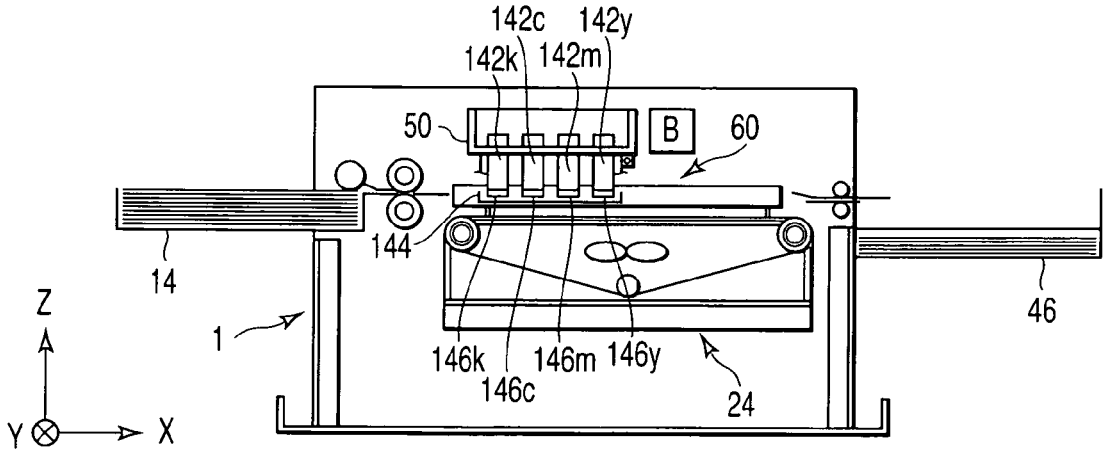
Figure 18C:
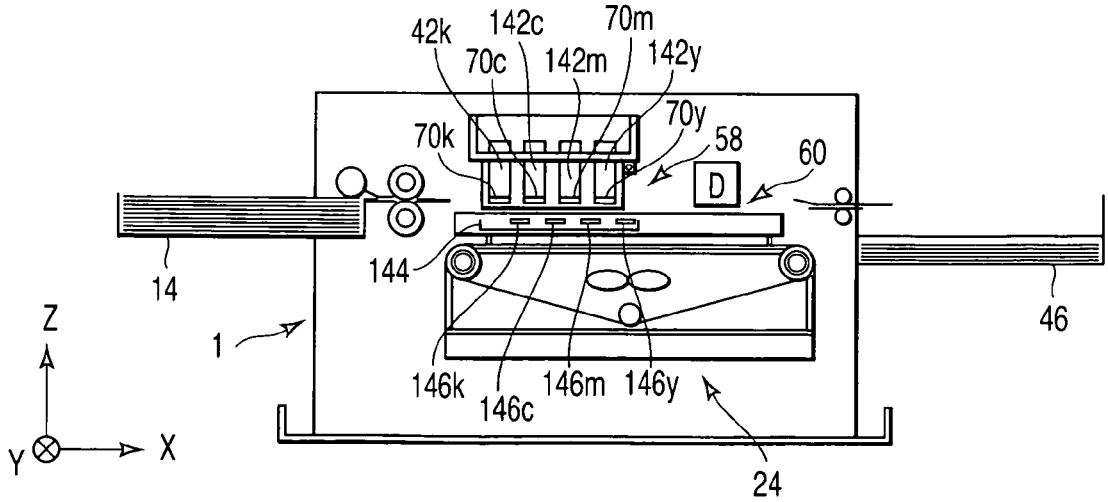

FIGS. 18A to 18C show the overall configuration of an ink-jet recording apparatus 1 according to a second embodiment of this invention. More precisely, FIG. 18A depicts the ink pan held at the wait position. FIG. 18B depicts the cap unit held at the ink-drawing position. FIG. 18C depicts the wiper unit held at the ink removal position.

As FIG. 18A shows, a head holder 50 is arranged above a belt unit 24. The head holder 50 holds a plurality of ink heads 142*k*, 142*c*, 142*m* and 142*y*.

Figure 19:
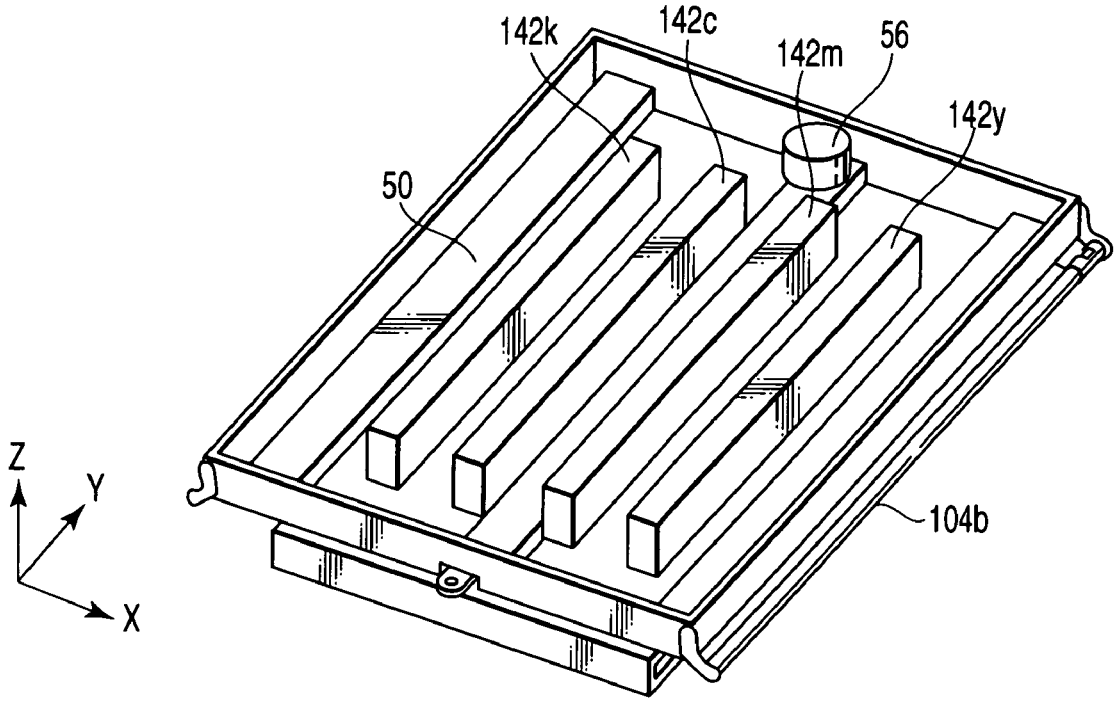
FIG. 19 is a diagram illustrating the arrangement of ink-head units used in the second embodiment.

As FIG. 19 shows, the ink heads 142*k*, 142*c*, 142*m* and 142*y* are line head, each being an elongated head. The ink heads 142*k*, 142*c*, 142*m* and 142*y* have nozzle surfaces 54*k*, 54*c*, 54*m* and 54*y*, respectively. Each nozzle surface has a plurality of nozzles (nozzles), which are arranged in a line. The ink heads 142*k*, 142*c*, 142*m* and 142*y* are so positioned that the nozzles made in any nozzle surface may be arranged in the direction of arrow Y, which intersects at right angles with the direction of arrow X in which a recording medium 16 is transported. The ink heads 142*k*, 142*c*, 142*m* and 142*y* are as long as or longer than the recording medium 16 is wide (as measured in the direction of arrow Y).

Figure 20:
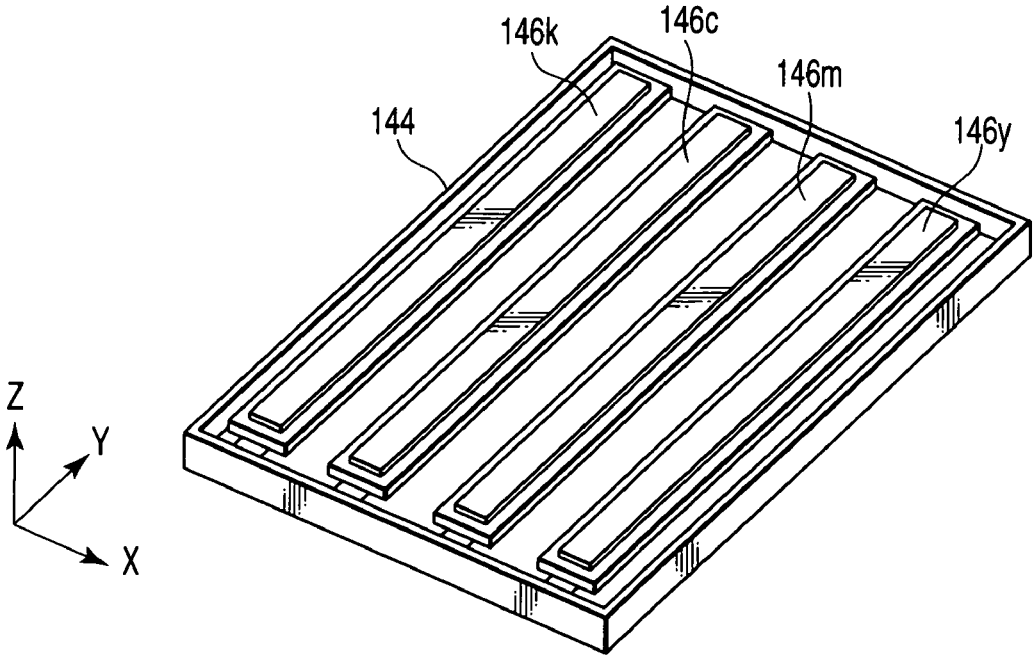
FIG. 20 is a diagram illustrating the arrangement of the protective caps of the cap units used in the second embodiment.

A cap unit 60 is provided, which has a plurality of protective caps 146*k*, 146*c*, 146*m* and 146*y* as shown in FIG. 20. The protective caps 146*k*, 146*c*, 146*m* and 146*y* are provided in the ink pan 144, in association with the ink heads 142*k*, 142*c*, 142*m* and 142*y*, respectively.

As shown in, for example, FIG. 18B, the protective caps 146*k*, 146*c*, 146*m* and 146*y* cap the nozzle surfaces 54*k*, 54*c*, 54*m* and 54*y*, respectively.

The ink pan 144 holds the ink dripped from the ink heads 142*k*, 142*c*, 142*m* and 142*y* and the ink removed from the nozzle surfaces 54*k*, 54*c*, 54*m* and 54*y*.

The cap unit 60 has a cap frame 66. The cap frame 66 is mounted on the belt unit 24. The cap unit 60 can therefore move up and down in the direction of arrow Z, while remaining mounted on and secured to the belt unit 24, as the belt unit 24 is moved up and down in the direction of arrow Z by a lift mechanism (not shown).

The ink pan 144 supported by the cap frame 66 can move in the direction of arrow X when driven by an X-direction drive mechanism (not shown).

Since the ink ban 144 can move in the direction of arrow X and the cap unit 66 can move up and down in the direction of arrow Z, the ink pan 144 can move to the following three positions. The first position is a wait position W shown in FIG. 18A. The second position is a capping position shown in FIG. 18B. The third position is an ink removal position D in FIG. 18C.

The wait position A is the position the cap unit 60 assumes when data such as an image is recorded on the recording medium 16. The capping position B is the position where the protective caps 146*k*, 146*c*, 146*m* and 146*y* abut on the ink heads 142*k*, 142*c*, 142*m* and 142*y*, respectively, closing and protecting the nozzle surfaces 54*k*, 54*c*, 54*m* and 54*y*, while the apparatus 1 remains not operating or not recording images. The ink removal position D is the position where the wiper blades 70*k*, 70*c*, 70*m* and 70*y* remove ink from the nozzle surfaces 54*k*, 54*c*, 54*m* and 54*y*. At this time, the ink pan 144 is so positioned that the protective caps 146*k*, 146*c*, 146*m* and 146*y* of the cap unit 60 may lie between the ink heads 142*k*, 142*c*, 142*m* and 142*y*.

Note that at the ink removal position D, the cap unit 60 does not interfere with the wiper unit 58 that has wiper blades 70*k*, 70*c*, 70*m* and 70*y*.

The ink jet recording apparatus 1 has pressure-applying mechanisms (not shown) to respectively pressurize the insides of the ink heads 142*k*, 142*c*, 142*m* and 142*y*. The pressure-applying mechanisms (not shown) are designed to raise the pressure in the ink heads 142*k*, 142*c*, 142*m* and 142*y*. When the pressure-applying mechanisms raises the pressure in the ink heads 142*k*, 142*c*, 142*m* and 142*y*, the ink heads 142*k*, 142*c*, 142*m* and 142*y* eject ink. The ink ejected from the ink heads 142*k*, 142*c*, 142*m* and 142*y* drip onto the ink pan 144. The ink dripped will be recovered from the ink pan 114 into a waste-liquid tank (not shown).

While the apparatus 140 remains not operating, the X-direction drive mechanism moves the ink pan 144 in the direction of arrow X, bringing the protective caps 146*k*, 146*c*, 146*m* and 146*y* to positions below the ink heads 142*k*, 142*c*, 142*m* and 142*y*, respectively. Thereafter, the lift mechanism moves the belt unit 24 upwards. As the belt unit is so moved, the cap unit 60 is moved upwards, too. The protective caps 146*k*, 146*c*, 146*m* and 146*y* therefore touch the nozzle surfaces 54*k*, 54*c*, 54*m* and 54*y*, protecting the nozzle surfaces 54*k*, 54*c*, 54*m* and 54*y*.

Figure 21:
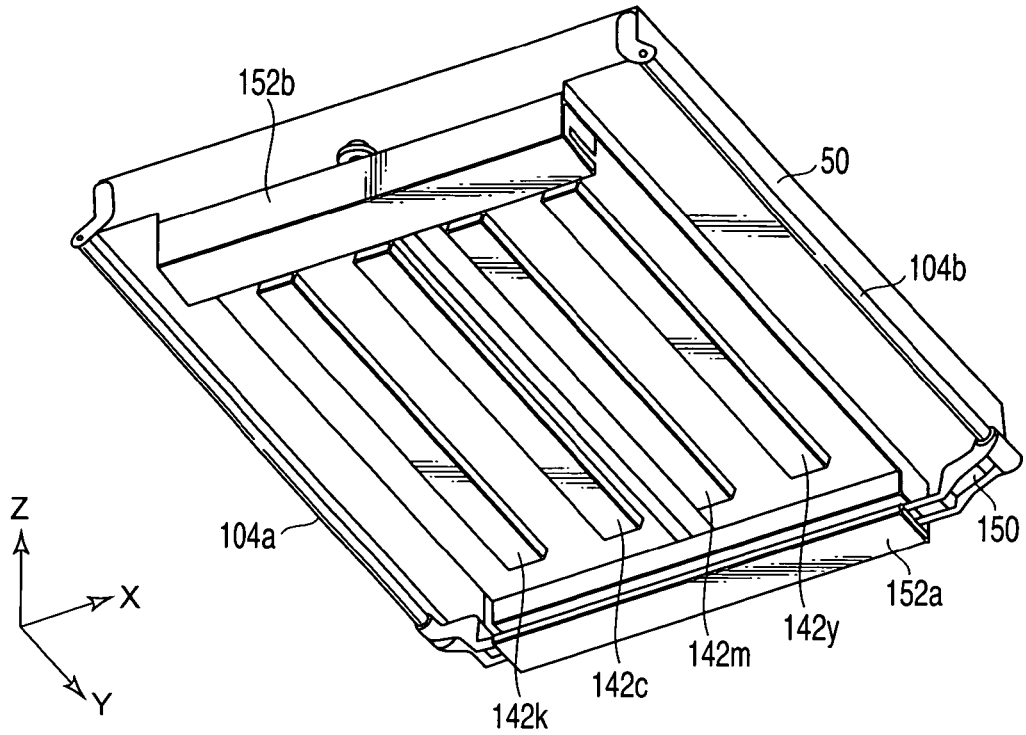
FIG. 21 is a diagram showing the head holder used in the second embodiment, as obliquely viewed from below.

As shown in FIG. 18C and FIG. 21, the head holder 50 holds the wiper unit 58. The wiper unit 58 wipes the nozzle surfaces 54*k*, 54*c*, 54*m* and 54*y* of the ink heads 142*k*, 142*c*, 142*m* and 142*y*. That is, the wiper unit 58 has wiper blades 70*k*, 70*c*, 70*m* and 70*y*, in association with the ink heads 142*k*, 142*c*, 142*m* and 142*y*, respectively.

Figure 22:
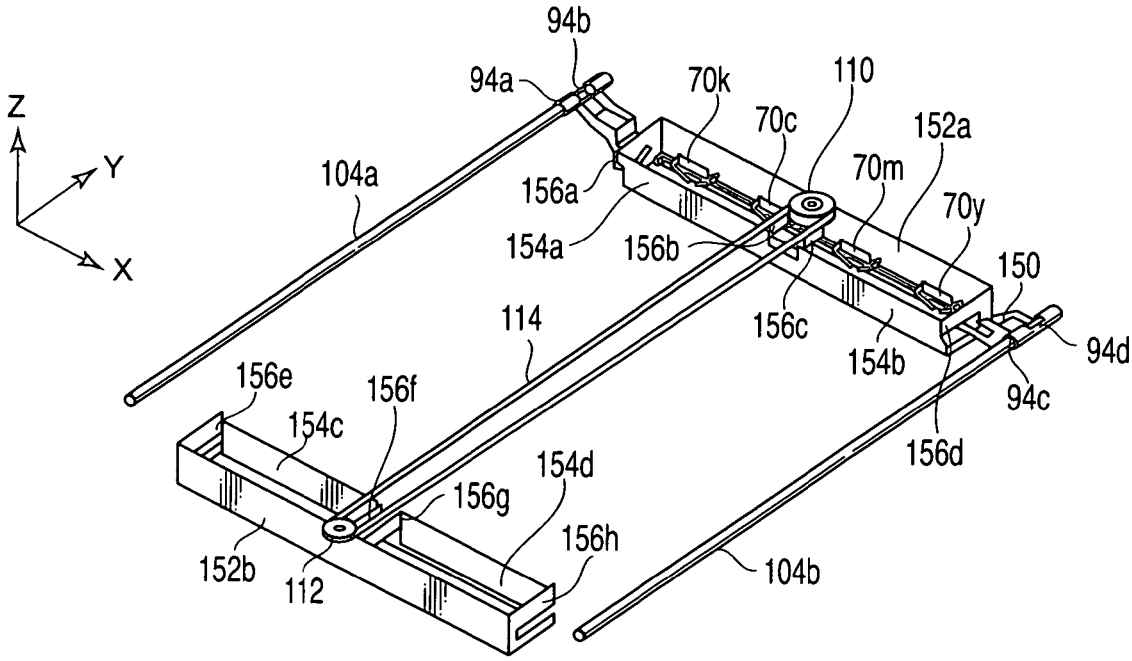
FIG. 22 is a diagram showing the path in which the wiper holder moves in the second embodiment.

FIG. 21 is a diagram showing the head holder 50 as obliquely viewed from below. FIG. 22 is a diagram showing the path in which the wiper holder 150 moves.

The wiper unit 58 removes ink from the nozzle surfaces 54*k*, 54*c*, 54*m* and 54*y* of the ink heads 142*k*, 142*c*, 142*m* and 142*y*. A wiping motor 56 secured to the head holder 50, at almost middle part thereof as viewed in the direction of arrow X. The shaft of the wiping motor 56A holds a pulley 110. Another pulley 112 is fixed in place, spaced apart from the pulley 110 in the lengthwise direction of the ink heads 142*k*, 142*c*, 142*m* and 142*y*. A belt 114 is wrapped around the pulleys 110 and 112.

To the head holder 50, guide shafts 104*a* and 104*b* are fastened. The guide shaft 104*a* is located upstream with respect to the direction of transporting the recoding medium 16. The guide shaft 104*b* is located downstream with respect to the direction of transporting the recoding medium 16. The guide shafts 104*a* and 104*b* extend parallel to the nozzles columns of the ink heads 142*k*, 142*c*, 142*m* and 142*y*.

Bushes 94*a* and 94*b* are mounted on one end of the guide shaft 104*a*. Similarly, bushes 94*c* and 94*d* are mounted on at the other end of the guide shaft 104*b*. The bushes 94*a* and 94*b* can slide on guide shaft 104*a*. The bushes 94*c* and 94*d* can slide on at the guide shaft 104*b*. Thus, the wiper holder 150 is supported, at ends, by the guide shafts 104*a* and 104 that are secured to the head holder 50 and can move in the direction of arrow Y. At the wiper holder 150, a belt holder 96 is provided. The belt holder 96 fastens the wiper holder 150 to the belt 114. The wiper holder 150 can therefore move as the belt 114 is driven.

The wiper holder 150, which can slide on the guide shafts 104*a* and 104*b*, moves back and forth in the direction of arrow Y between the pulleys 110 and 114, as the wiping motor 56 is driven. Wiper storages 152*a* and 152*b* as an accommodation unit are provided, respectively, at the ends of the path in which the wiper holder 150 moves back and forth.

The wiper storage 152*a* has covers 154*a* and 154*b*, and the wiper storage 152*b* has covers 154*c* and 154*d*. Cover shafts 156*a* and 156*b* are provided at the ends of the cover 154*a*, enabling the cover 154*a* to rotate with respect to the wiper storage 152*a*. Similarly, cover shafts 156*c* and 156*d* are provided at the ends of the cover 154*b*, enabling the cover 154*b* to rotate with respect to the wiper storage 152*b*. Further, cover shafts 156*d* and 156*f* are provided at the ends of the cover 154*c*, enabling the cover 154*c* to rotate with respect to the wiper storage 152*b*. And cover shafts 156*g* and 156*h* are provided at the ends of the cover 154*d*, enabling the cover 154*d* to rotate with respect to the wiper storage 152*a*. Hence, the covers 154*a*, 154*b*, 154*c* and 154*d* can open and close the wiper storages 152*a* and 152*b*.

Figure 23:
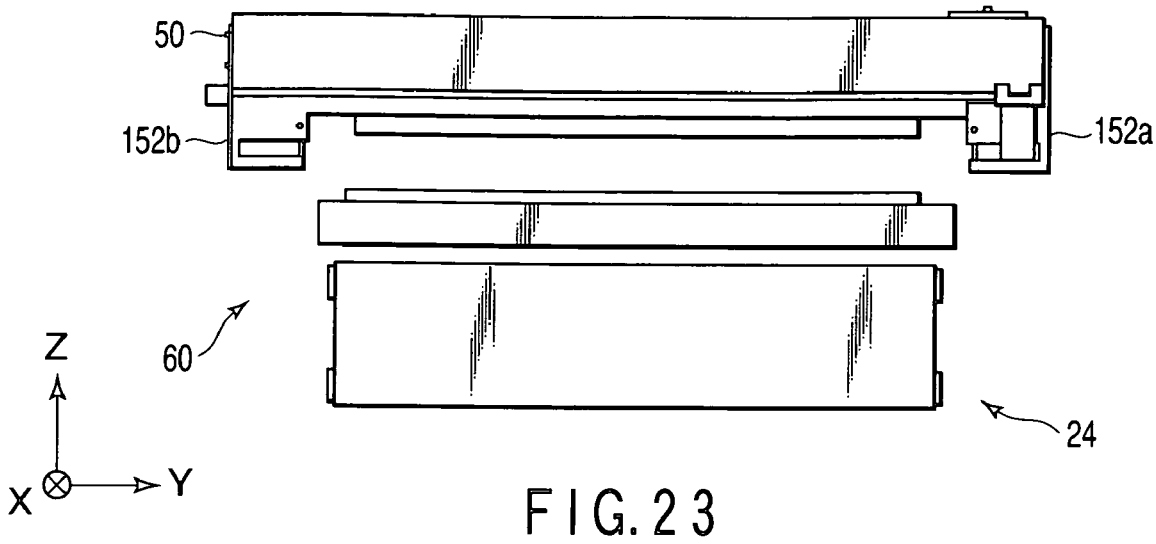
FIG. 23 is a side view representing the positional relation that the head holder, cap unit, belt unit and wiper storages have in the second embodiment.

FIG. 23 is a side view representing the positional relation that the head holder 50, cap unit 60, belt unit 24 and wiper storages 152*a* and 152*b* have at the ink removal position D, as viewed from one side of the apparatus 1. The wiper storages 152*a* and 152*b* are arranged outside the region to which ink is ejected from the ink heads 142*k*, 142*c*, 142*m* and 142*y*. More precisely, the wiper storages 152*a* and 152*b* are outside the projected area of the belt unit 24 and the cap unit 60.

Figure 24:
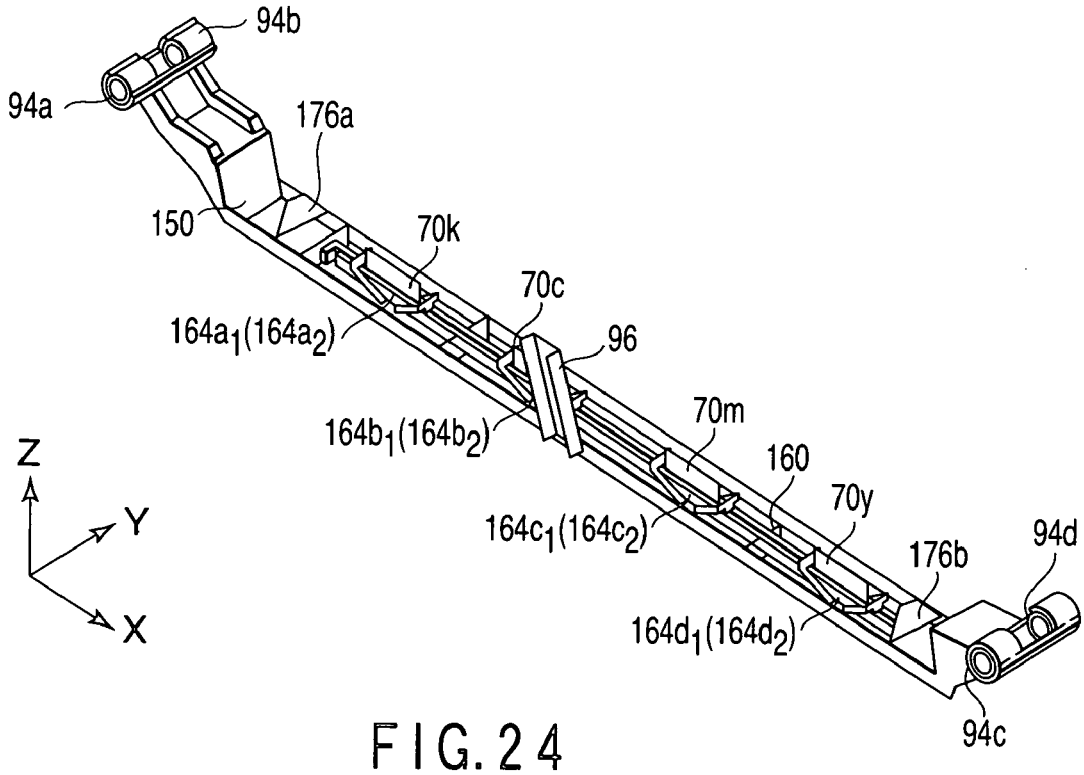
FIG. 24 is a diagram showing the wiper holder provided in the second embodiment.

FIG. 24 is a perspective view representing the shape of the wiper holder 150.

A blade holder 160 is held to the wiper holder 150. The blade holder 160 holds the wiper blades 70*k*, 70*c*, 70*m* and 70*y*. The wiper blades 70*k*, 70*c*, 70*m* and 70*y* are made of elastic material such as rubber or resin. The wiper blades 70*k*, 70*c*, 70*m* and 70*y* are provided for ink heads 142*k*, 142*c*, 142*m* and 142*y*, respectively. The belt holder 96 described above is provided on the wiper holder 150.

Figure 25:
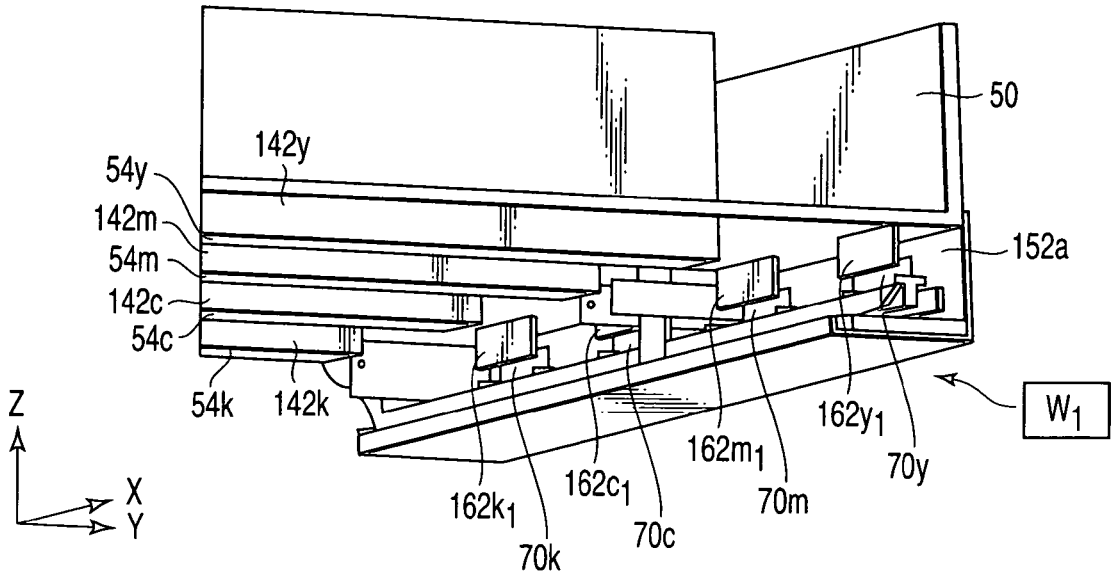
FIG. 25 is a diagram depicting the wiper holder held at the wait position in one of the wiper storages provided in the second embodiment.
Figure 26:
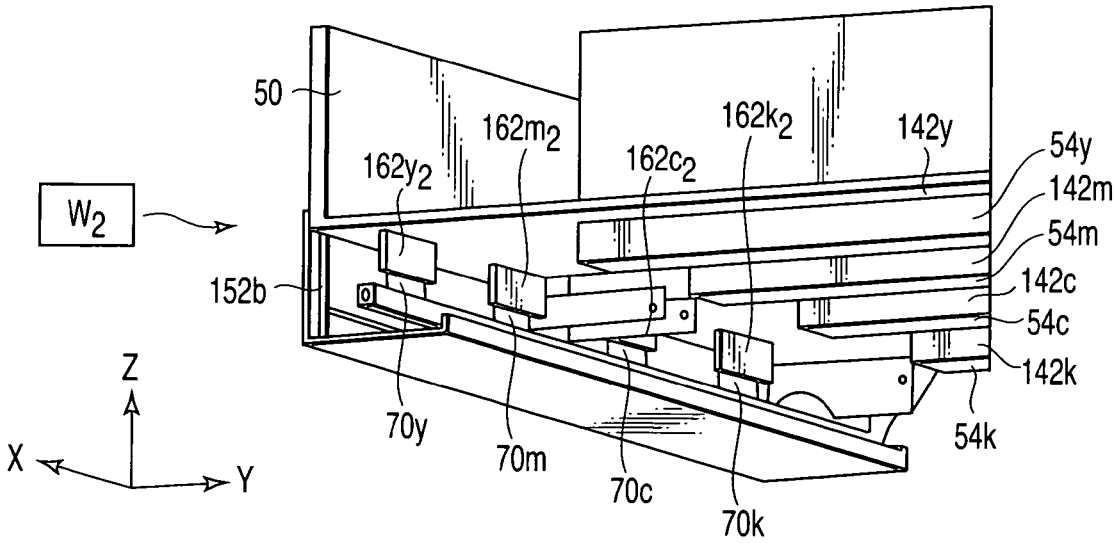
FIG. 26 is a diagram depicting the wiper holder held at the wait position in the other wiper storage that is provided in the second embodiment.

FIG. 25 is a diagram depicting the wiper holder 150 held at the wait position $W_1$ in the wiper storage 152*a*. FIG. 26 is a diagram depicting the wiper holder 150 held at the wait position $W_2$ in the wiper storage 152*b*.

In the wiper storage 152*a*, blade cleaners $\mathbf{162}k_1$, $\mathbf{162}c_1$, $\mathbf{162}m_1$ and $\mathbf{162}y_1$ are provided in association with the wiper blades 70*k*, 70*c*, 70*m* and 70*y*, respectively. Similarly, in the wiper storage 152*b*, blade cleaners $\mathbf{162}k_2$, $\mathbf{162}c_2$, $\mathbf{162}m_2$ and $\mathbf{162}y_2$ are provided in association with the wiper blades 70*k*, 70*c*, 70*m* and 70*y*, respectively.

The blade cleaners $\mathbf{162}k_1$, $\mathbf{162}c_1$, $\mathbf{162}m_1$ and $\mathbf{162}y_1$ and the blade cleaners $\mathbf{162}k_2$, $\mathbf{162}c_2$, $\mathbf{162}m_2$ and $\mathbf{162}y_2$ hang from the head holder 50. The blade cleaners are so positioned that they may touch the wiper blades 70$k$, 70$c$, 70$m$ and 70$y$ while the wiper blades 70$k$, 70$c$, 70$m$ and 70$y$ are moved.

Figure 27:
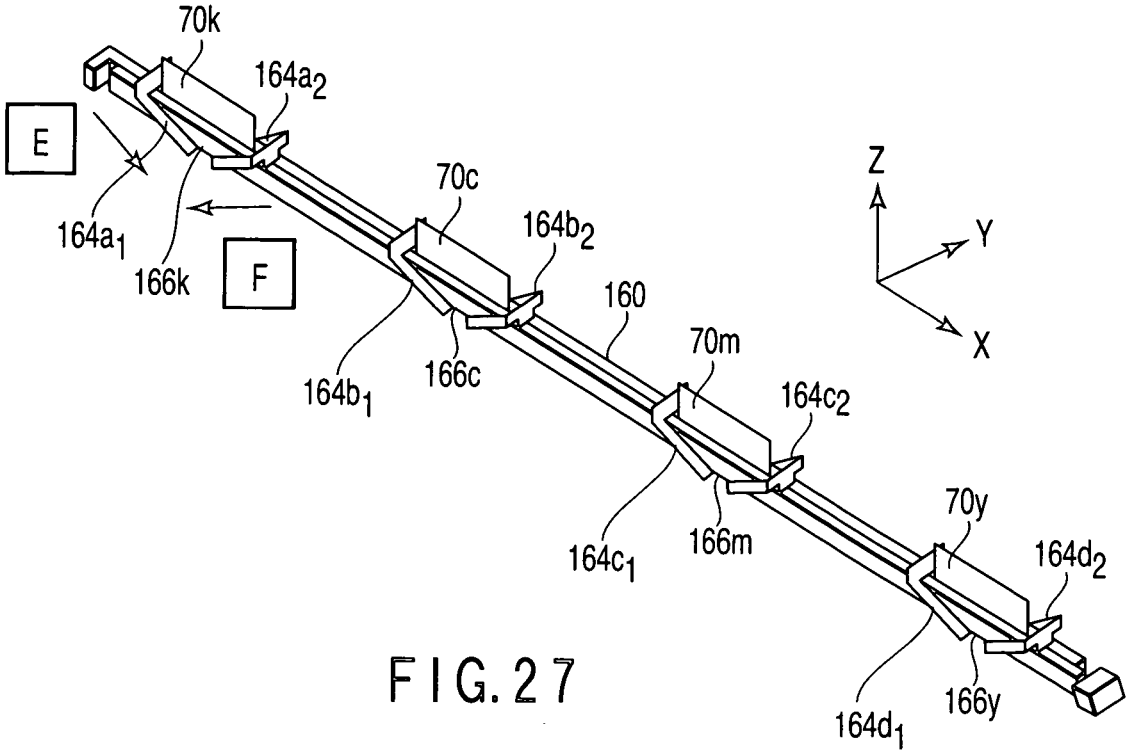
FIG. 27 is a diagram illustrating the ink guides provided on the blade holder used in the second embodiment.

FIG. 27 is a perspective view representing the shape of the blade holder 160.

As FIG. 27 shows, ink guides 164$a_1$, 164$a_2$, 164$b_1$, 164$b_2$, 164$c_1$, 164$c_2$, 164$d_1$ and 164$d_2$ are provided on the sides of the blade holder 160. The ink guides 164$a_1$ and 164$a_2$ are inclined so that the ink removed by the wiper blades 70$k$ flow down by its weight in the directions of arrows E and F. The other ink guides 164$b_1$, 164$b_2$, 164$c_1$, 164$c_2$, 164$d_1$ and 164$d_2$ are similar in configuration to ink guides 164$a_1$ and 164$a_2$. The ink is therefore guided from the wiper blades 70$k$, 70$c$, 70$m$ and 70$y$ to the projections 166$k$, 166$c$, 166$m$ and 166$y$ located below them, along ink guides 164$a_1$, 164$a_2$, 164$b_1$, 164$b_2$, 164$c_1$, 164$c_2$, 164$d_1$ and 164$d_2$.

Figure 28:
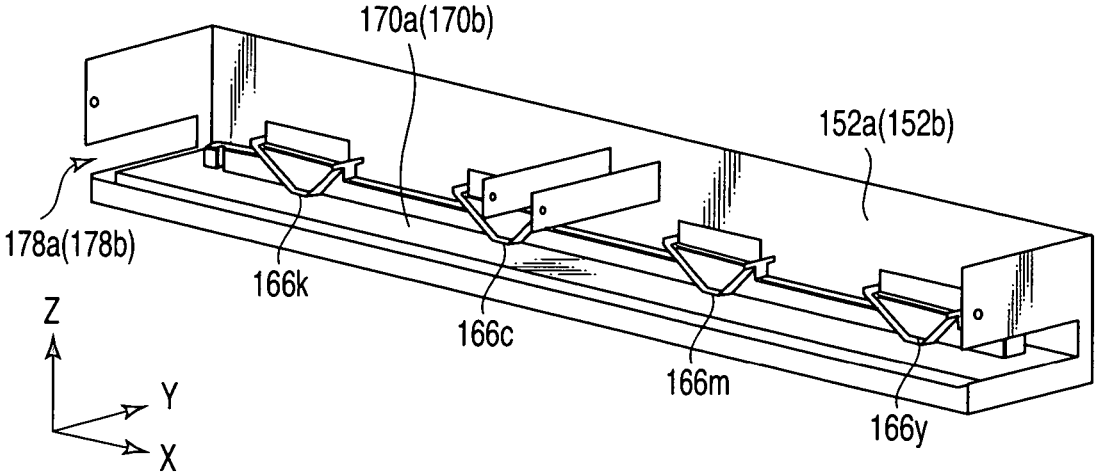
FIG. 28 is a diagram depicting the blade holder staying in the wiper storage used in the second embodiment.

FIG. 28 is a diagram depicting the blade holder 160 staying at the wait position $W_1$ or $W_2$ in the wiper storage 152$a$ or 152$b$.

Ink-absorbing pads 170$a$ and 170$b$ are provided on the bottoms of the wiper storages 152$a$ and 152$b$, respectively. When the blade holder 160 is inserted into the wiper storages 152$a$ and 152$b$, the projections 166$k$, 166$c$, 166$m$ and 166$y$ of the blade holder 160 contact the ink-absorbing pads 170$a$ and 170$b$.

More specifically, as the wiper blades 70$k$, 70$c$, 70$m$ and 70$y$ move in contact with the nozzle surfaces 54$k$, 54$c$, 54$m$ and 54$y$ of the ink heads 142$k$, 142$c$, 142$m$ and 142$y$, they remove ink from the nozzle surfaces 54$k$, 54$c$, 54$m$ and 54$y$. The ink thus removed flows, by its weight, flows to the blade holder 160 that lies below the wiper blades 70$k$, 70$c$, 70$m$ and 70$y$. The ink is then guided to the projections 166$k$, 166$c$, 166$m$ and 166$y$, by the ink guides 164$a_1$, 164$a_2$, 164$b_1$, 164$b_2$, 164$c_1$, 164$c_2$, 164$d_1$ and 164$d_2$ that are provided on the blade holder 160. Once introduced into the wiper storages 152$a$ and 152$b$, the ink guided to the projections 166$k$, 166$c$, 166$m$ and 166$y$ is absorbed into the ink-absorbing pads 170$a$ and 170$b$.

Figure 29:
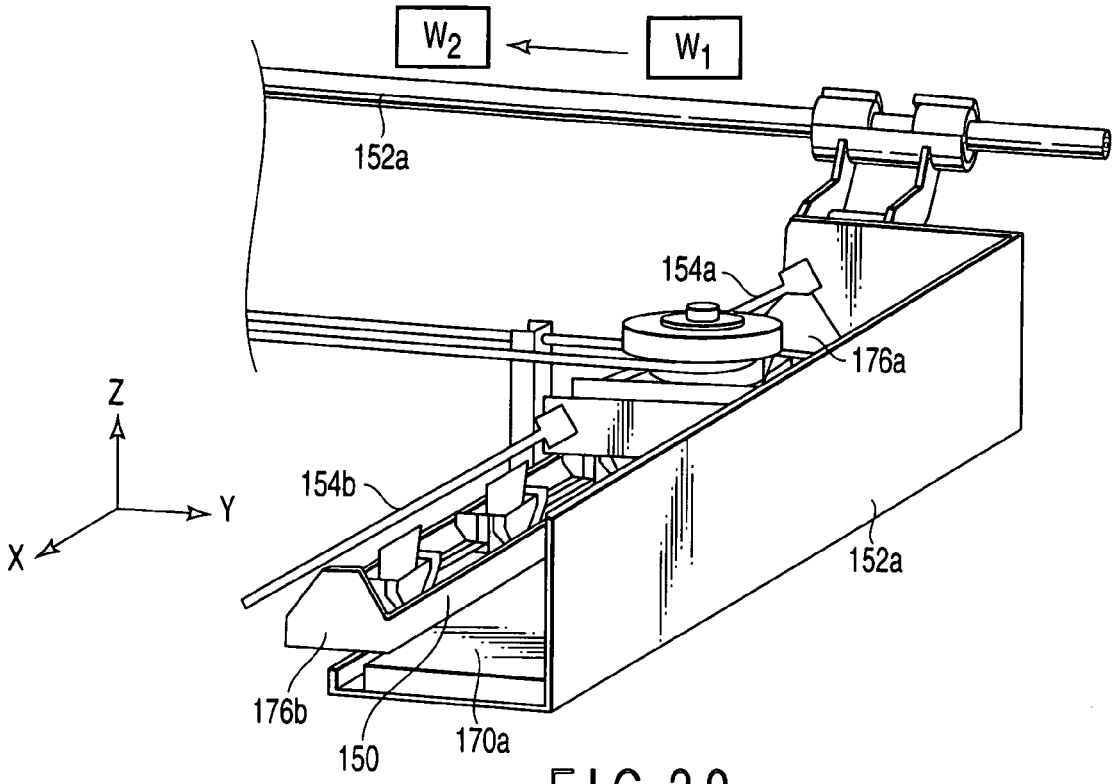
FIG. 29 is a diagram depicting the position the covers in the second embodiment.
Figure 30:
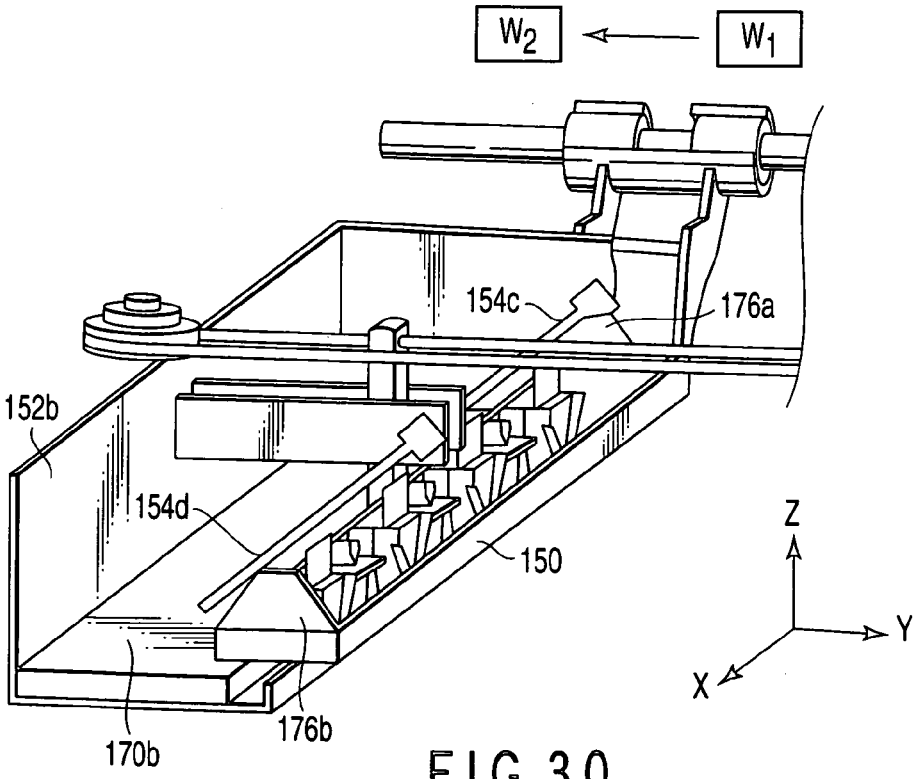
FIG. 30 is a diagram depicting the position the cover in the second embodiment.

FIG. 29 is a diagram illustrating how the covers 152$a$ and 152$b$ open as the wiper holder 150 moves from the wiper storage 152$a$ to the wiper storage 152$b$. FIG. 30 is a diagram illustrating how the covers 154$c$ and 154$d$ open as the wiper holder 150 is moved from the wiper storage 152$a$ to the wiper storage 152$b$.

To make the wiper blades 70$k$, 70$c$, 70$m$ and 70$y$ wipe the nozzle surfaces 54$k$, 54$c$, 54$m$ and 54$y$, the ink holder 150 moves from the wiper storage 154$a$, opening the covers 154$a$ and 154$b$. At this point, guides 176$a$ and 176$b$ provided on the wiper holder 150 abuts on the covers 154$a$ and 154$b$, respectively. The covers 154$a$ and 154$b$ are thereby rotated around the cover shafts 156$a$ and 156$b$ and the cover shafts 156$c$ and 156$d$, respectively, and are opened up. As the wiper holder 150 further moves, the cover 154$a$ and 154$b$ no longer touch the guides 176$a$ and 176$b$. As a result, the covers 154$a$ and 154$b$ are closed by their weights.

The wiper holder 150 moves still further, reaching a position right before the wiper storage 152$b$. Then, the guides 176$a$ and 176$b$, which are provided on the wiper holder 150, abut on the covers 154$c$ and 154$d$, respectively. The covers 154$c$ and 154$d$ are therefore rotated around the cover shafts 156$e$, 156$f$, 156$g$ and 156$h$, opening toward the interior of the wiper storage 152$b$. When the covers 154$c$ and 154$d$ cease to abut on the guides 176$a$ and 176$b$, the covers 154$c$ and 154$d$ are closed by their weights. The sequence of the operation just described proceeds in reverse order when the wiper holder 150 moves from the wiper storage 152$b$ to the wiper storage 152$a$.

How the cleaning is performed in the ink-jet recording apparatus 1 so configured as described above will be explained below.

To commence the cleaning, the lift mechanism moves the belt unit 24 down. As the belt unit 24 is moved down, the lift mechanism lowers the cap unit 60 to such a level that the protective caps 146$k$, 146$c$, 146$m$ and 146$y$ of the cap unit 60 may lie below the nozzle surfaces 54$k$, 54$c$, 54$m$ and 54$y$ of the ink heads 142$k$, 142$c$, 142$m$ and 142$y$, and that a space may be provided, in which the wiper unit 58 can wipe the nozzle surfaces 54$k$, 54$c$, 54$m$ and 54$y$ of the ink heads 142$k$, 142$c$, 142$m$ and 142$y$.

Thereafter, the ink pan 144 is moved in the direction of arrow X, thereby positioning the ink heads 142$k$, 142$c$, 142$m$ and 142$y$ at the ink removal position D, where the nozzle surfaces 54$k$, 54$c$, 54$m$ and 54$y$ do not lie right below the protective caps 146$k$, 146$c$, 146$m$ and 146$y$. In this state, the pressure-applying mechanism (not shown) is driven, applying a pressure in the ink heads 142$k$, 142$c$, 142$m$ and 142$y$. Ink is thereby ejected from the ink heads 142$k$, 142$c$, 142$m$ and 142$y$.

The foreign matter, such as dust or paper duct generated as recording medium are thereby forced out, together with the ink, through the nozzles made in the nozzle surfaces 54$k$, 54$c$, 54$m$ and 54$y$. The ink drips into the ink pan 144 and recovered in the waste-liquid tank (not shown) that is connected to the ink pan 144.

While the above-mentioned pressure is being applied, the wiper holder 150 remains at the wait position $W_1$ in the wiper storage 152$a$. After the pressure has been applied, the wiping motor 56 is driven in the forward direction. The pulley 110, which is coupled to the wiping motor 56, is rotated. The belt 114 is therefore driven between the pulley 110 and the pulley 112. The wiper holder 150 is fastened to the belt 114 by the belt holder 96. The wiper holder 150 therefore moves from the wait position $W_1$ in the wiper storage 152$a$, to the wait position $W_2$ in the wiper storage 152$b$, as the belt 114 is driven.

When the wiper holder 150 moves from the wiper storage 152$a$, the guides 176$a$ and 176$b$ of the wiper holder 150 abut on the covers 154$a$ and 154$b$. Therefore, the covers 154$a$ and 154$b$ are opened, rotating around the cover shafts 156$a$, 156$b$, 156$c$ and 156$d$. When the wiper holder 150 fully comes out of the wiper storage 152$a$, the covers 154$a$ and 145$b$ take a vertical position due to their weight. The opening 178$a$ of the wiper storage 152$a$ is thereby closed.

The wiper holder 150 moves immediately below the ink heads 142$k$, 142$c$, 142$m$ and 142$y$, maintaining its present position. The wiper blades 70$k$, 70$c$, 70$m$ and 70$y$, which are held by the blade holder 160, contact the nozzle surfaces 54$k$, 54$c$, 54$m$ and 54$y$ of the ink heads 142$k$, 142$c$, 142$m$ and 142$y$, respectively, while elastically bent. The wiper blades 70$k$, 70$c$, 70$m$ and 70$y$ therefore remove ink from the nozzle surfaces 54$k$, 54$c$, 54$m$ and 54$y$.

The wiper holder 150 eventually reaches the covers 154$c$ and 154$d$ provided at the wiper storage 152$b$. At this point, the guide 176$a$ and 176$b$ of the wiper holder 150 abut on the covers 154$c$ and 154$d$. The covers 154$c$ and 154$d$ therefore rotate around the cover shafts 156$e$, 156$f$, 156$g$ and 156$h$ and are thus opened toward the wiper storage 152$b$. Then, the wiper holder 150 moves into the wiper storage 152$b$. The guide 176$c$ and 176$d$ no longer abut on the cover 154$c$ and 154$d$. Hence, the cover 154$c$ and 154$d$ are closed by their weight.

Once the wiper holder 150 has moved into the wiper storage 152$b$, the wiper blades 70$k$, 70$c$, 70$m$ and 70$y$ move in contact with the blade cleaners 162$k_2$, 162$c_2$, 162$m_2$ and

162$y_2$ that hang from the head holder 50. The ink which bonded to wiper blades 70*k*, 70*c*, 70*m*, 70*y* is removed. When the wiper holder 150 stops at the wait position $W_2$, the projections 166*k*, 166*c*, 166*m* and 166*y* protruding from the blade holder 160 abut on the ink-absorbing pad 170*b* provided on the bottom of the wiper storage 152*b*. The ink-absorbing pad 170*b* absorbs the ink guided to the projections 166*k*, 166*c*, 166*m* and 166*y* by the ink guides 164*a*$_1$, 164*a*$_2$, 164*b*$_1$, 164*b*$_2$, 164*c*$_1$, 164*c*$_2$, 164*d*$_1$ and 164*d*$_2$. Thus ends the clearing.

No image-forming instructions may be after the cleaning has been completed. In this case, the X-direction drive mechanism moves the ink pan 144 back in the direction of arrow X (that is, in −X direction), bringing the protective caps 146*k*, 146*c*, 146*m* and 146*y* to positions immediately below the ink heads 142*k*, 142*c*, 142*m* and 142*y*, respectively. Thereafter, the lift mechanism moves the belt unit 24 upwards. As the belt unit is so moved, the cap unit 60 is moved upwards, too. The protective caps 146*k*, 146*c*, 146*m* and 146*y* therefore touch the ink heads 142*k*, 142*c*, 142*m* and 142*y*, respectively. Thus, the protective caps 146*k*, 146*c*, 146*m* and 146*y* protect the nozzle surfaces 54*k*, 54*c*, 54*m* and 54*y*.

An image-forming instruction may be made after the cleaning has been completed. If this is the case, the X-direction drive mechanism moves the ink pan 144 in the direction of arrow X, to a position where the ink pan 144 does not oppose the head holder 15. Thereafter, the lift mechanism holding the belt unit 24 moves upwards. As the belt unit is so moved, the cap unit 60 is moved toward the wait position A. Then, an image is formed.

In order to perform the cleaning process again, the cap unit 60 is moved to the ink removal position D. In this state, the pressure-applying mechanism (not shown) is driven, applying the pressure in the ink heads 142*k*, 142*c*, 142*m* and 142*y*. Ink is thereby ejected from the ink heads 142*k*, 142*c*, 142*m* and 142*y*.

While the above-mentioned pressure is being applied, the wiper holder 150 remains at the wait position $W_2$ in the wiper storage 152*b*. After the pressure has been applied, the wiping motor 56 is driven in the reverse direction. As a result, the wiper holder 150 moves from the wait position $W_2$ in the wiper storage 152*b*, to the wait position $W_1$ in the wiper storage 152*a*. When the wiper holder 150 moves from the wiper storage 152*b*, the guides 176*a* and 176*b* abut on the covers 154*c* and 154*d*, rotating the covers 154*c* and 154*d* around the cover shafts 156*e*, 156*f*, 156*g* and 156*h* into their opened positions.

When the wiper holder 150 fully comes out of the wiper storage 152*b*, the covers 154*c* and 145*d* take a vertical position due to their weight. The opening 178*b* of the wiper storage 152*b* is thereby closed. The wiper holder 150 moves immediately below the ink heads 142*k*, 142*c*, 142*m* and 142*y*, maintaining its present position. The wiper blades 70*k*, 70*c*, 70*m* and 70*y*, which are held by the blade holder 160 remove ink from the nozzle surfaces 54*k*, 54*c*, 54*m* and 54*y*.

The wiper holder 150 eventually reaches the covers 154*a* and 154*b* provided at the wiper storage 152*a*. At this point, the guide 176*a* and 176*b* of the wiper holder 150 abut on the covers 154*a* and 154*b*. The covers 154*a* and 154*b* therefore rotate around the cover shafts 156*a*, 156*b*, 156*c* and 156*d* and are thus opened toward the wiper storage 152*a*. Now that the covers 154*a* and 154*b* are opened, the wiper holder 150 moves into the wiper storage 152*a*. The guide 176*a* and 176*b* no longer abut on the cover 154*a* and 154*b*. Hence, the cover 154*a* and 154*b* are closed by their weight.

Once the wiper holder 150 has moved into the wiper storage 152*a*, the wiper blades 70*k*, 70*c*, 70*m* and 70*y* move in contact with the blade cleaners 162*k*$_1$, 162*c*$_1$, 162*m*$_1$ and 162*y*$_1$ that hang from the head holder 50. The ink which bonded to wiper blades 70*k*, 70*c*, 70*m*, 70*y* is removed. When the wiper holder 150 stops at the wait position $W_1$, the projections 166*k*, 166*c*, 166*m* and 166*y* protruding from the blade holder 160 abut on the ink-absorbing pad 170*a* provided on the bottom of the wiper storage 152*a*. The ink-absorbing pad 170*a* absorbs the ink guided to the projections 166*k*, 166*c*, 166*m* and 166*y* by the ink guides 164*a*$_1$, 164*a*$_2$, 164*b*$_1$, 164*b*$_2$, 164*c*$_1$, 164*c*$_2$, 164*d*$_1$ and 164*d*$_2$. Thus ends the clearing.

The second embodiment has two wiper storages 152*a* and 152*b* on the ends of the head holder 50, respectively. The wiper blades 70*k*, 70*c*, 70*m* and 70*y* can be cleaned, by moving the wiper holder 150 in one direction only, not back and forth. This can shorten the time required for accomplishing the cleaning. In addition, foreign matter, such as paper dust adhere neither to the wiper blades 70*k*, 70*c*, 70*m* and 70*y* nor to the blade cleaners 162*k*$_1$, 162*k*$_2$, 162*c*$_1$, 162*c*$_2$, 162*m*$_1$, 162*m*$_1$, 162*y*$_1$ and 162*y*$_2$, because the blade cleaners 162*k*$_1$, 162*k*$_2$, 162*c*$_1$, 162*c*$_2$, 162*m*$_1$, 162*m*$_1$, 162*y*$_1$ and 162*y*$_2$ for cleaning the wiper blades 70*k*, 70*c*, 70*m* and 70*y* are provided in the wiper storages 152*a* and 152*b*. Thus, the nozzle surfaces 54*k*, 54*c*, 54*m* and 54*y* can remain clean at all times.

Further, the guide shafts 104*a* and 104*b* extend along the sides of the head holder 50, guiding the wiper holder 150, and the wiper motor 56 is arranged substantially in the middle with respect to the direction in which head holder 50 is moved. The wiper holder 150 can therefore move stably and smoothly, without vibrating. The nozzle surfaces 54*k*, 54*c*, 54*m* and 54*y* can therefore be wiped uniformly.

In the second embodiment, the wiper holder 150 is moved one way only to wipe the nozzle surfaces 54*k*, 54*c*, 54*m* and 54*y* once. Nonetheless, the wiper holder 150 may be moved in another way if the apparatus 1 has been left unused for a long time and the ink has solidified in the nozzles and/or on the nozzle surfaces 54*k*, 54*c*, 54*m* and 54*y*.

For example, the wiper blades wiper blades 70, 70*c*, 70*m* and 70*y* may wipe the nozzle surfaces 54*k*, 54*c*, 54*m* and 54, twice during a single cleaning process. For example, the wiper blades 70, 70*c*, 70*m* and 70*y* are moved forward on the nozzle surfaces 54*k*, 54*c*, 54*m* and 54*y*, while the pressure-applying mechanism (not shown) is forcing the ink from the nozzles of the ink heads 142*k*, 142*c*, 142*m* and 142*y*, thereby removing ink from the nozzle surfaces 54*k*, 54*c*, 54*m* and 54*y*. Then, the wiper blades 70, 70*c*, 70*m* and 70*y* are moved back on the nozzle surfaces 54*k*, 54*c*, 54*m* and 54*y*, removing the ink from the nozzle surfaces 54*k*, 54*c*, 54*m* and 54*y*.

Embodiments of the present invention have been described. The present invention is not limited to the embodiments, nevertheless. Various changes and modifications can, of course, be made without departing from the scope and spirit of the invention.

Further, the embodiments described above include various phases of the invention. The components disclosed herein may be combined in various ways to make various inventions. Even if some components of any embodiment described above are not used, it is possible to achieve the object specified above. Any configuration not using some components can be considered as the invention so long as it achieves at least one of the advantages that will be stated in the "Advantages of the Invention."

The present invention can provide an ink-jet recording apparatus in which the nozzle surface of the ink heads and the wiper blades that may contact the nozzle surfaces can be positioned with high precision and foreign matter, if any, can be reliably removed from the nozzle surfaces.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An ink-jet recording apparatus comprising:

a transporting mechanism which transports a recording medium;

an ink-head unit that has at least one ink head extending in a direction at right angles with a direction in which the recording medium is fed, the ink head having a nozzle surface in which a plurality of nozzles are arranged, through which ink is ejected to record an image, the ink head being at least as wide as the recording medium;

a head-holding unit which holds the ink-head unit to be opposed to the transporting mechanism; and a blade unit which has a wiper blade for wiping the nozzle surface, wherein the blade unit is held by the head-holding unit;

a cap unit which caps the nozzle surface of the ink-head unit, wherein the cap unit is opposed to the head-holding unit while the wipe blade wipes the nozzle surface, and wherein the blade unit moves between the head-holding unit and the cap unit to wipe the nozzle surface.

2. An ink-jet recording apparatus comprising:

a transporting mechanism which transports a recording medium;

an ink-head unit that has at least one ink head extending in a direction at right angles with a direction in which the recording medium is fed, the ink head having a nozzle surface in which a plurality of nozzles are arranged, through which ink is ejected to record an image, the ink head being at least as wide as the recording medium;

a head-holding unit which holds the ink-head unit to be opposed to the transporting mechanism;

a blade unit which has a wiper blade for wiping the nozzle surface, wherein the blade unit is held by the head-holding unit; and an accommodation unit provided at the head-holding unit for accommodating the blade unit, wherein the accommodation unit includes a door.

3. The ink-jet recording apparatus according to claim 2, wherein the door remains closed while the blade unit is being accommodated in the accommodation unit.

4. An ink-jet recording apparatus comprising:

a transporting mechanism which transports a recording medium;

an ink-head unit that has at least one ink head extending in a direction at right angles with a direction in which the recording medium is fed, the ink head having a nozzle surface in which a plurality of nozzles are arranged, through which ink is ejected to record an image, the ink head being at least as wide as the recording medium;

a head-holding unit which holds the ink-head unit to be opposed to the transporting mechanism; and a blade unit which has a wiper blade for wiping the nozzle surface, wherein the blade unit is held by the head-holding unit;

an accommodation unit provided at the head-holding unit for accommodating the blade unit; and a cleaning member for cleaning the blade unit provided in the accommodation unit.

5. The ink-jet recording apparatus according to claim 4, wherein the cleaning member hangs from the head-holding unit.

* * * * *